US008875804B2

(12) United States Patent
Puzio et al.

(10) Patent No.: US 8,875,804 B2
(45) Date of Patent: Nov. 4, 2014

(54) SCREWDRIVING TOOL HAVING A DRIVING TOOL WITH A REMOVABLE CONTACT TRIP ASSEMBLY

(75) Inventors: Daniel Puzio, Baltimore, MD (US); Craig A. Schell, Baltimore, MD (US); Joseph P. Kelleher, Towson, MD (US); Scott Eshleman, Towson, MD (US); Andrew E. Seman, Pylesville, MD (US); Todd A. Hagan, Towson, MD (US); Joseph G. Stauffer, Towson, MD (US); Will Wang, Suzhou (CN); John D. Cox, Towson, MD (US)

(73) Assignee: Black & Decker Inc., Newark, DE (US)

( * ) Notice: Subject to any disclaimer, the term of this patent is extended or adjusted under 35 U.S.C. 154(b) by 736 days.

(21) Appl. No.: 12/982,711

(22) Filed: Dec. 30, 2010

(65) Prior Publication Data

US 2012/0090863 A1 Apr. 19, 2012

Related U.S. Application Data

(60) Provisional application No. 61/293,122, filed on Jan. 7, 2010.

(51) Int. Cl.

| | |
|---|---|
| ***E21B 15/04*** | (2006.01) |
| ***B25B 23/00*** | (2006.01) |
| ***B25B 21/02*** | (2006.01) |
| ***B25F 5/00*** | (2006.01) |

(52) U.S. Cl.

CPC ..... *B25B 23/0064* (2013.01); *B25B 21/02* (2013.01); *B25F 5/003* (2013.01)

USPC ..... 173/2

(58) Field of Classification Search

USPC ..... 173/1–11, 176–183, 39–56, 81–91, 173/112–115, 141, 144, 148, 213, 217, 173/170–171; 227/1–7, 107–156

See application file for complete search history.

(56) References Cited

U.S. PATENT DOCUMENTS

| | | | | | |
|---|---|---|---|---|---|
| 3,572,181 | A | * | 3/1971 | Schlegel | 8/16 |
| 4,185,701 | A | * | 1/1980 | Boys | 173/183 |
| 4,418,765 | A | * | 12/1983 | Mori et al. | 173/182 |
| 4,813,312 | A | * | 3/1989 | Wilhelm | 81/467 |
| 5,154,242 | A | * | 10/1992 | Soshin et al. | 173/178 |

(Continued)

FOREIGN PATENT DOCUMENTS

| | | | |
|---|---|---|---|
| DE | 3912991 | A1 | 10/1990 |
| DE | 19626731 | A1 | 1/1998 |
| DE | 202006009348 | U1 | 9/2006 |
| EP | 0591096 | A1 | 4/1994 |

*Primary Examiner* — Robert Long

(74) *Attorney, Agent, or Firm* — Harness, Dickey & Pierce, P.L.C.

(57) ABSTRACT

A screwdriving tool that includes a driving tool (driver), a sensor, a sensor target and a contact trip assembly that is coupled to the driving tool and has a nose element. The driver has a housing, a motor and an output member that is driven by the motor. One of the nose element and the output member is axially movable and biased by a spring into an extended position. The sensor and sensor target are configured to cooperate to permit the sensor to provide a sensor signal that is indicative of movement of the one of the nose element and the output member. The motor is controllable in a first operational mode and at least one rotational direction based in part on the sensor signal.

15 Claims, 29 Drawing Sheets

(56) References Cited

U.S. PATENT DOCUMENTS

| | | | | |
|---|---|---|---|---|
| 5,601,387 | A | 2/1997 | Sanford et al. | |
| 5,848,859 | A * | 12/1998 | Clark et al. | 408/1 R |
| 6,158,929 | A * | 12/2000 | Fisher | 408/1 R |
| 6,431,289 | B1 | 8/2002 | Potter et al. | |
| 6,634,439 | B2 | 10/2003 | Driessen | |
| 6,675,911 | B2 | 1/2004 | Driessen | |
| 7,021,399 | B2 | 4/2006 | Driessen | |
| 7,220,088 | B2 * | 5/2007 | Ferrari et al. | 409/204 |
| 7,828,630 | B2 | 11/2010 | Robson et al. | |
| 8,042,717 | B2 * | 10/2011 | Lam et al. | 227/7 |
| 2002/0104207 | A1 * | 8/2002 | Smith et al. | 29/26 A |
| 2003/0196824 | A1 * | 10/2003 | Gass et al. | 173/131 |
| 2006/0037766 | A1 * | 2/2006 | Gass et al. | 173/20 |
| 2009/0206122 | A1 | 8/2009 | King | |
| 2010/0175902 | A1 * | 7/2010 | Rejman et al. | 173/1 |
| 2011/0315414 | A1 * | 12/2011 | Kuntner et al. | 173/1 |

* cited by examiner

SCREWDRIVING TOOL HAVING A DRIVING TOOL WITH A REMOVABLE CONTACT TRIP ASSEMBLY

BACKGROUND

The present disclosure relates to a screwdriving tool having a driving tool with a removable contact trip assembly.

SUMMARY

This section provides a general summary of the disclosure, and is not a comprehensive disclosure of its full scope or all of its features.

We have found that it is common in the building trades to assemble framework with cordless impact drivers and attach the drywall with corded screwguns. We envision a system that allows the user to get more versatility from an assembly tool, such as an impact driver. When the contact trip assembly is not attached to the driving tool, the driving tool performs in its typical manner. When the contact trip assembly is attached to the driving tool, the driving tool takes on the ability to drive drywall, sheathing and decking fasteners to an accurate and repeatable depth.

We have found that this approach provides a small and compact screwdriver. We have found that when the driving tool is an impact driver, the impact driver provides the desired speed for driving low torque screws fast and can also provide additional torque when needed. We have further found that the contact trip assembly, sensor, and on-board controller could eliminate the need for a mechanical clutch that is typical of systems that provide depth control. Eliminating the mechanical clutch could provide a much more compact system with minimal to no change in clutch performance due to wear or mechanical breakdown of mechanical clutch surfaces.

Another potential advantage associated with the elimination of a mechanical clutch concerns the capability to provide depth sensing without requiring the operator to exert and maintain a large axial force directed through the screwdriving tool onto the fastener. While each of the examples disclosed herein employs a biasing spring, we note that the spring is relatively light due to the fact that it is not associated with the mechanical operation of a clutch but rather the placement of a sensor or sensor target that is employed to electronically control the operation of the screwdriving tool.

Additionally, coupling such a contact trip assembly, sensor and controls with drill drivers and hammer drills could also provide accurate depth control when the contact trip assembly is attached to the driving tool and also not hinder or compromise the other functions or capabilities of such tools when the contact trip assembly is removed. We note, however, that we have also found that the contact trip assembly could be permanently mounted to the driving tool and that such assembly would be advantageous in some situations.

In one form, the present teachings provide a screwdriving tool that includes a driving tool, a contact trip assembly that is coupled to the driving tool, a sensor and a sensor target. The driving tool has a tool housing, a motor assembly and an output member that is driven by the motor assembly. The contact trip assembly has a nose element. One of the nose element and the output member is axially movable and biased by a spring into an extended position. One of the sensor and the sensor target is coupled to the tool housing, while the other one of the sensor and the sensor target is coupled to the one of the output member and the nose element for axial movement relative to the one of the sensor and the sensor target. The sensor provides a sensor signal that is based upon a distance between the sensor and the sensor target. The motor assembly is controllable in a first operational mode and at least one rotational direction based in part on the sensor signal.

In another form, the present teachings provide a screwdriving tool that includes a brushed DC motor, a motor direction switch and a direction sensing circuit. The motor direction switch is movable into first and second switch positions to alternate connection of the brushes of the DC motor to first and second terminals. The direction sensing circuit is configured to generate a first signal indicative the coupling of one of the brushes to the first terminal and a second signal indicative of the coupling of the one of the brushes to the second terminal. The first and second signals being generated when the brushed DC motor is operated for a time exceeding a predetermined amount of time.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
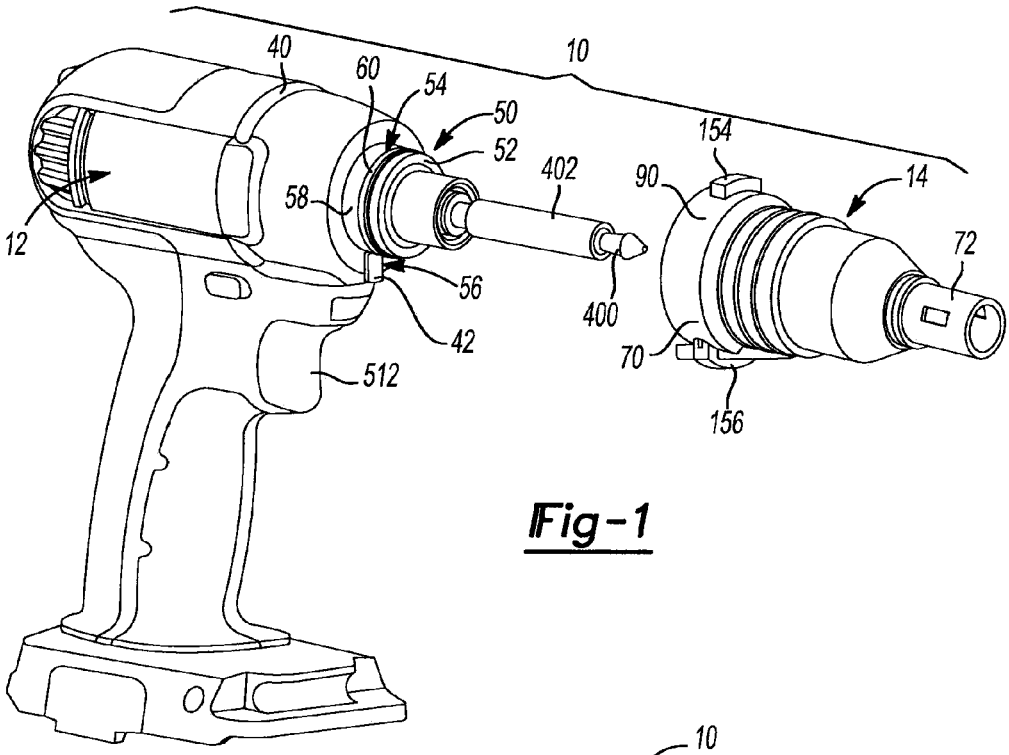
FIG. 1 is an exploded perspective view of a screwdriving tool constructed in accordance with the teachings of the present disclosure.
Figure 2:
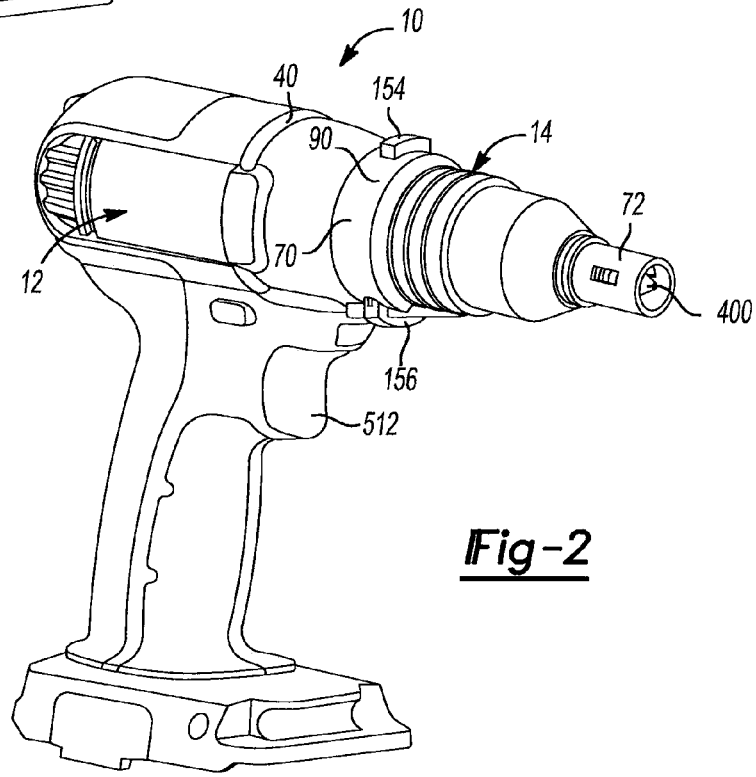
FIG. 2 is a perspective view of the screwdriving tool of FIG. 1.

With reference to FIGS. 1 and 2 of the drawings, an exemplary screwdriving tool constructed in accordance with the teachings of the present disclosure is generally indicated by reference numeral 10. The screwdriving tool 10 can comprise a driving tool 12 and a contact trip assembly 14 that can be removably coupled to the driving tool 12.

The driving tool 12 can be any type of power tool that is configured to provide a rotary output for driving a threaded fastener, such as a drill/driver, a hammer-drill/driver, an impact driver or a hybrid impact driver. Except as noted herein, the driving tool 12 may be conventionally constructed (e.g., where the driving tool 12 is a drill/driver, the driving tool 12 may be generally similar to the drill/drivers disclosed in U.S. Pat. No. 7,537,064, which is hereby incorporated by reference, and/or a model DCD920 drill/driver that is commercially available from the DeWalt Industrial Tool Company of Towson, Md.; where the driving tool 12 is a hammer-drill/driver, the driving tool may be generally similar to the hammer-drill/drivers disclosed in U.S. Pat. No. 7,314,097, which is hereby incorporated by reference, and/or a model DCD950 hammer-drill/driver that is commercially available from the DeWalt Industrial Tool Company of Towson, Md.; where the driving tool 12 is an impact driver, the driving tool 12 may be generally similar to a model DC826 impact driver that is commercially available from the DeWalt Industrial Tool Company of Towson, Md.; and where driving tool 12 is a hybrid impact driver, the driving tool may be generally similar to the driving tools disclosed in U.S. patent application Ser. No. 12/566,046, all of which are hereby incorporated by reference).

Figure 2A:
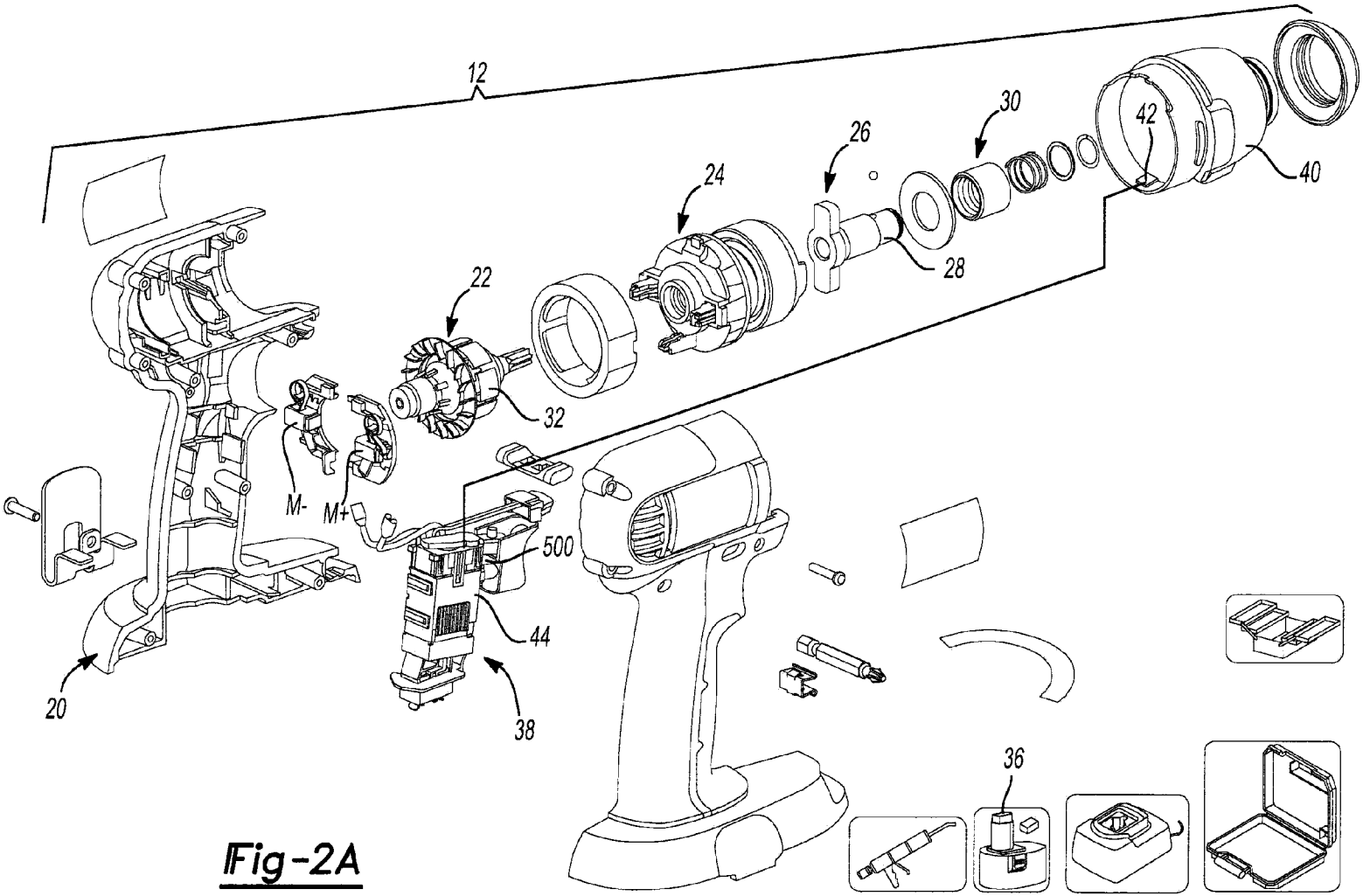
FIG. 2A is an exploded perspective view of a portion of the screwdriving tool of FIG. 1 illustrating the driving tool in more detail.

With reference to FIG. 2A, the driving tool 12 in the particular example provided is generally similar to a model DC825KA impact driver, which is commercially available from the DeWalt Industrial Tool Company of Towson, Md., in that it includes a clam shell housing 20, a motor assembly 22, a transmission 24, an impact mechanism 26, an output spindle 28 and a chuck 30. The motor assembly 22 can comprise any type of motor, such as an AC motor, a DC motor, or a pneumatic motor. In the particular example provided, the motor assembly 22 includes a brushed DC electric motor 32 that is selectively coupled to a battery pack 36 via a trigger assembly 38. Additionally, the driving tool 12 comprises a gear case 40, a sensor 42 and a controller 44.

With reference to FIGS. 1 and 2A, the gear case 40 can be unitarily formed from an appropriate material, such as aluminum, magnesium or a reinforced plastic, and can be coupled to the clam shell housing 20 so as to cover or shroud the transmission 24 and the impact mechanism 26. The gear case 40 can be a container-like structure that can include front end 50 that defines a mounting stem 52, a first attachment member 54 and a sensor mount 56. The mounting stem 52 can comprise a hollow stem structure 58 through which the output spindle 28 can extend. In the example provided, the stem structure 58 includes a generally cylindrical portion, but it will be appreciated that the stem structure 58 could be formed with one or more portions having a non-circular cross-sectional shape that can aid in inhibiting rotation of the contact trip assembly 14 relative to the driving tool 12. The first attachment member 54 can comprise any means for retaining the contact trip assembly 14 to the driving tool 12, including without limitation a thread form or a locking tab. In the example provided, the first attachment member 54 comprises a portion of the stem structure 58 into which an annular, circumferentially extending groove 60 is formed. The sensor mount 56 can comprise a structure that can be assembled to or integrally formed with the gear case 40 that is configured to hold or secure the sensor 42. While the sensor mount 56 can be configured to permit physical access to the sensor 42 through the gear case 40, or could be configured to shroud the sensor 42 such that the sensor 42 is not accessible from the exterior of the driving tool 12. The sensor mount 56 can be shaped or configured to cooperate with the contact trip assembly 14 to resist or inhibit rotation of the contact trip assembly 14 relative to the stem structure 58.

The sensor 42 can be any type of sensor that can be employed to detect the physical presence of the contact trip assembly 14. Suitable sensors include without limitation Hall effect sensors, eddy current sensors, magnetoresistive sensors, limit switches, proximity switches, and optical sensors. In the particular example provided, the sensor 42 comprises a Hall effect sensor that is configured to generate a sensor signal that is responsive to the sensing of a magnetic field of a predetermined field strength.

The controller 44 can be electrically coupled to (or integrated into) the trigger assembly 38 and can be configured to cooperate with the trigger assembly 38 to control the operation of the motor assembly 22 as will be described in more detail below.

Figure 3:
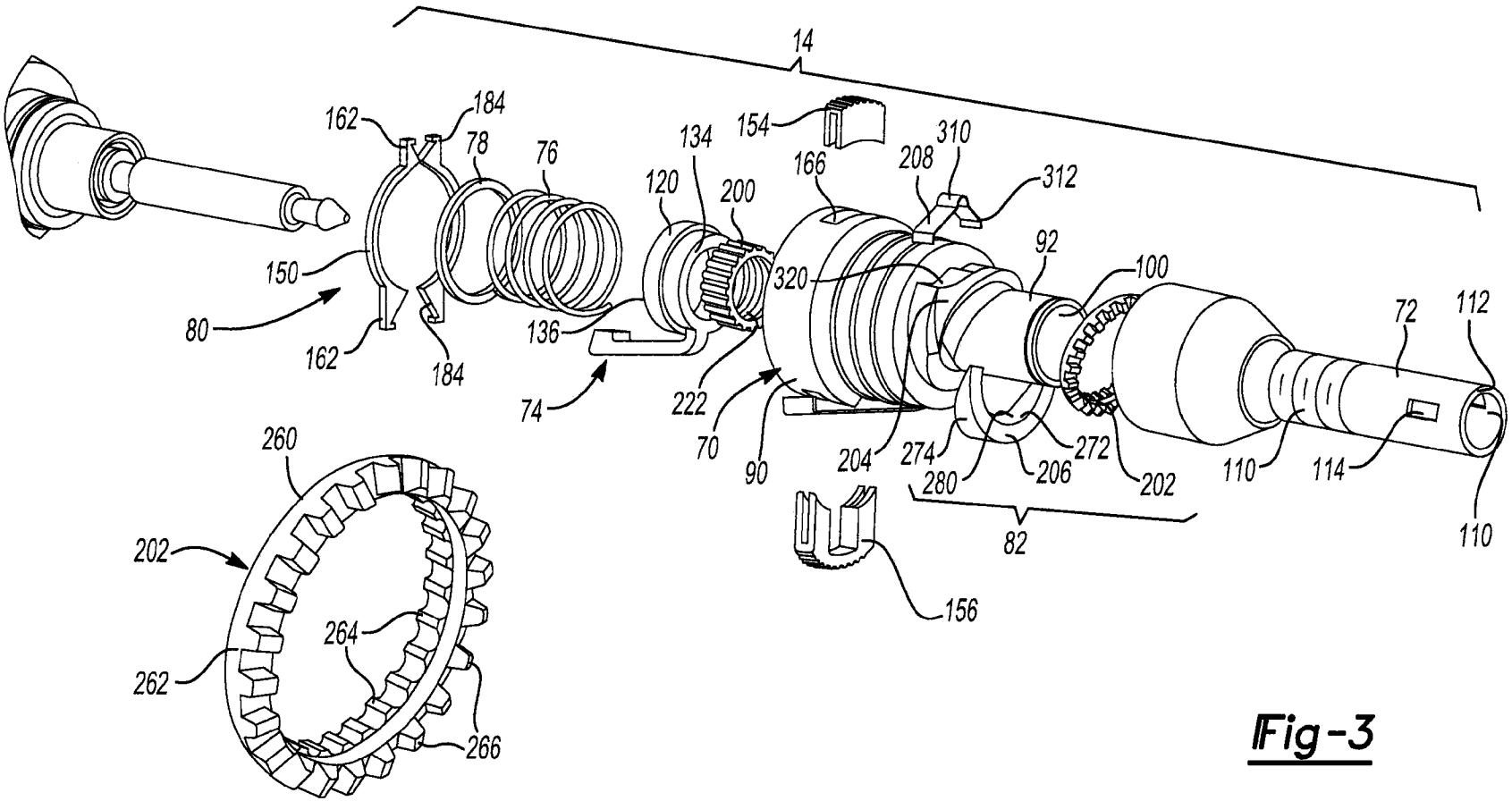
FIG. 3 is an exploded perspective view of a portion of the screwdriving tool of FIG. 1, illustrating the contact trip assembly in more detail.
Figure 4:
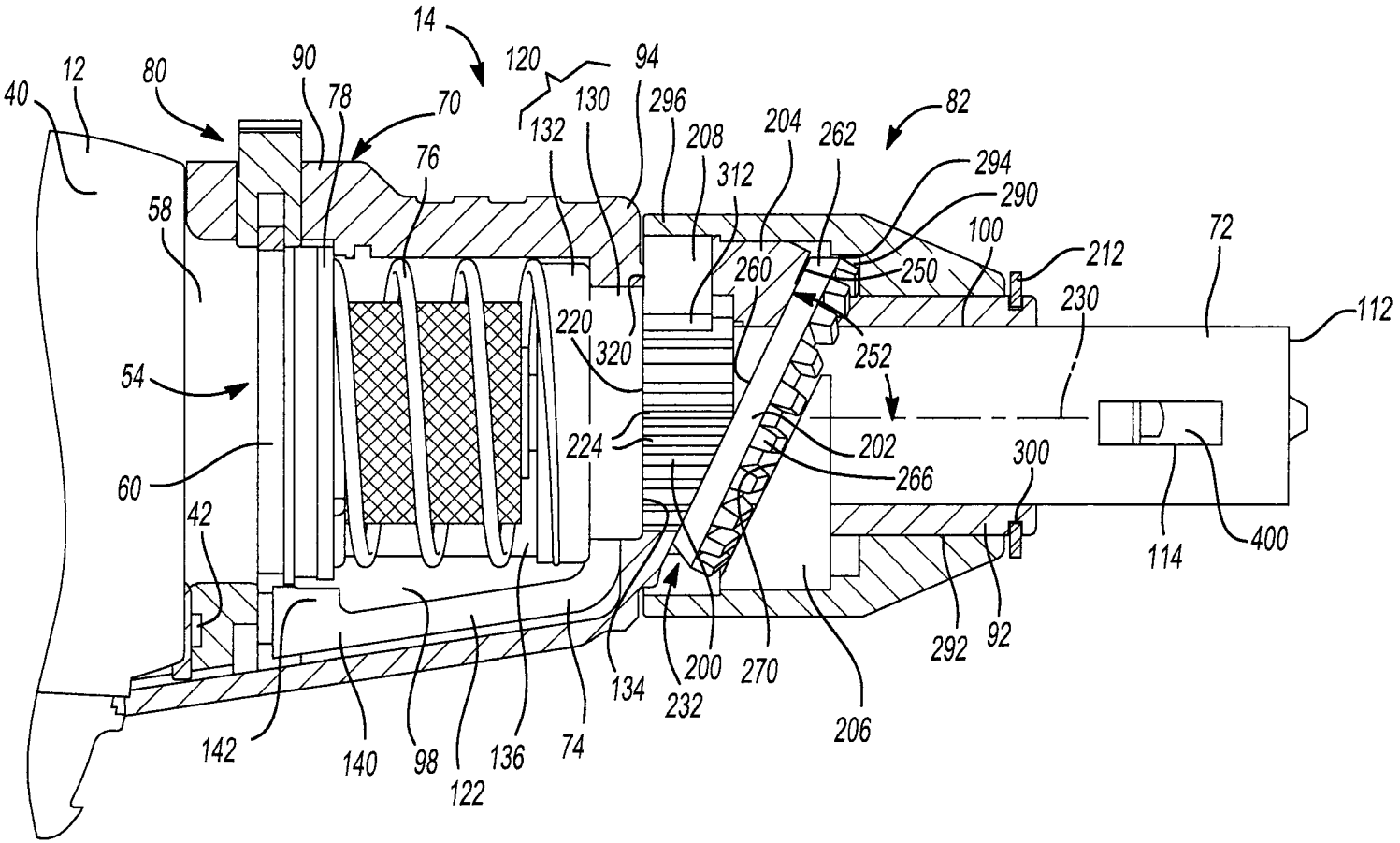
FIGS. 4 and 5 are longitudinal section views of a portion of the screwdriving tool of FIG. 1.

With reference to FIGS. 3 and 4, the contact trip assembly 14 can comprise a contact trip housing 70, a nose element 72, a sensor structure 74, a first biasing spring 76, a spring retainer 78, a retaining mechanism 80 and means 82 for adjusting a position of the nose element 72 relative to the sensor structure 74.

The contact trip housing 70 can be defined by a wall member that can form a mount 90, a barrel 92 and a shoulder 94 that is disposed between the mount 90 and the barrel 92. The mount 90 can define a mount cavity 98 and can be configured to engage the front end of the gear case 40 in a desired manner. For example, the mount 90 can be configured to be received over and engage the mounting stem 52 (FIG. 1) as well as the sensor mount 56 (FIG. 1) such that the contact trip housing 70 is oriented to the driving tool 12 in a predetermined orientation. The barrel 92 can extend forwardly of the shoulder 94 and can define a barrel aperture 100 that can extend through the shoulder 94 and intersect the mount cavity 98.

The nose element 72 can be a generally tubular structure having a plurality of first threads 110 formed on a proximal or first end, and an abutting face 112 formed on a distal or second end. One or more sight windows 114 formed through nose element 72 proximate the second end. The nose element 72 can be received into the barrel aperture 100 and can include a geometric feature, such as ribs or grooves (not specifically shown) that can matingly engage grooves or ribs (not specifically shown) that extend from the barrel 92 into the barrel aperture 100. It will be appreciated from this disclosure that mating engagement of the geometric features (e.g., grooves -) in/on the nose element 72 with mating geometric features (e.g., ribs -) in/on the barrel 92 can inhibit rotation of the nose element 72 relative to the barrel 92.

The sensor structure 74 can include a sensor body 120 and a sensor arm 122. The sensor body 120 can comprise a first annular portion 130 and a second annular portion 132. The first annular portion 130 can define a first abutting face 134 and can be received in the barrel aperture 100 such that it extends into or through the shoulder 94. The second annular portion 132 can be somewhat larger in diameter than the first annular portion 130 and can be received in the mount cavity 98. The second annular portion 132 can define a second abutting face 136 that can be disposed on a side of the sensor body 120 opposite the first abutting face 134. The sensor arm 122 can comprise an arm member 140, which can be fixedly coupled to the sensor body 120, and a sensor target 142 that can be coupled to the arm member 140 on a side opposite the sensor body 120. The sensor target 142 can be configured such that it may be sensed or operate the sensor 42 in the driving tool 12 (as will be explained in more detail, below), but in the example provided, the sensor target 142 comprises a magnet.

The first biasing spring 76 can be received in the mount cavity 98 and can be abut the second abutting face 136. The spring retainer 78 can be a washer-like structure or a spring clip that can be received in the mount cavity 98 and coupled to the contact trip housing 70 so as to compress the first biasing spring 76 against the sensor body 120 such that the first biasing spring 76 biases the second annular portion 132 against the shoulder 94.

Figure 6:
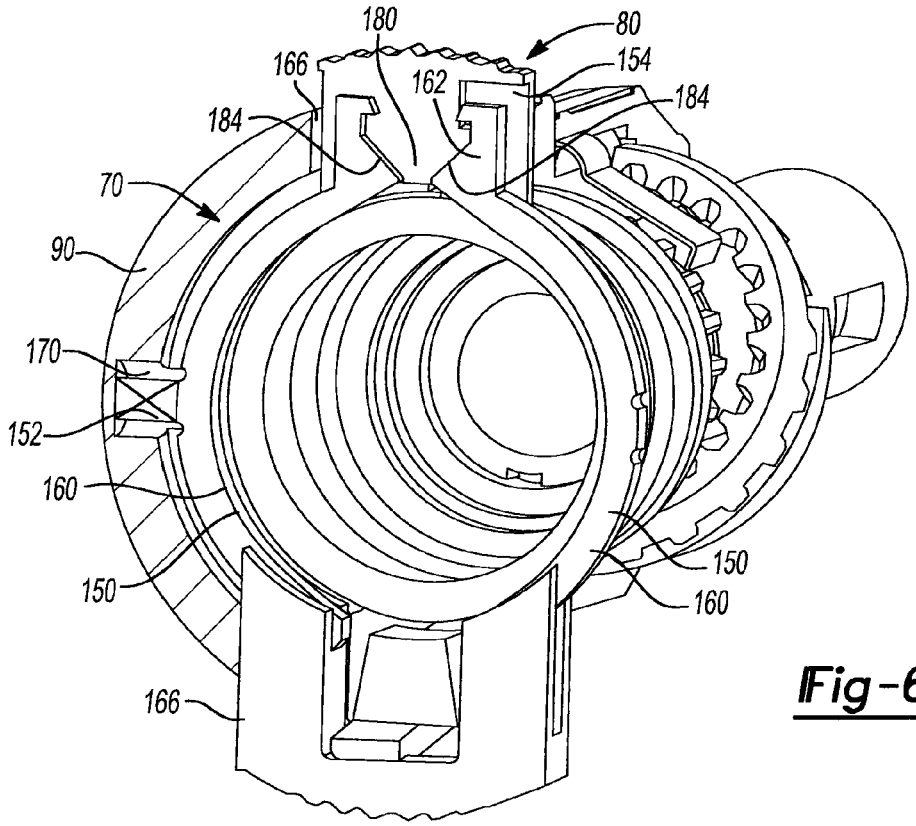
FIGS. 6 and 7 are lateral section views through the contact trip assembly illustrating the clip in its normal and deflected states.
Figure 7:
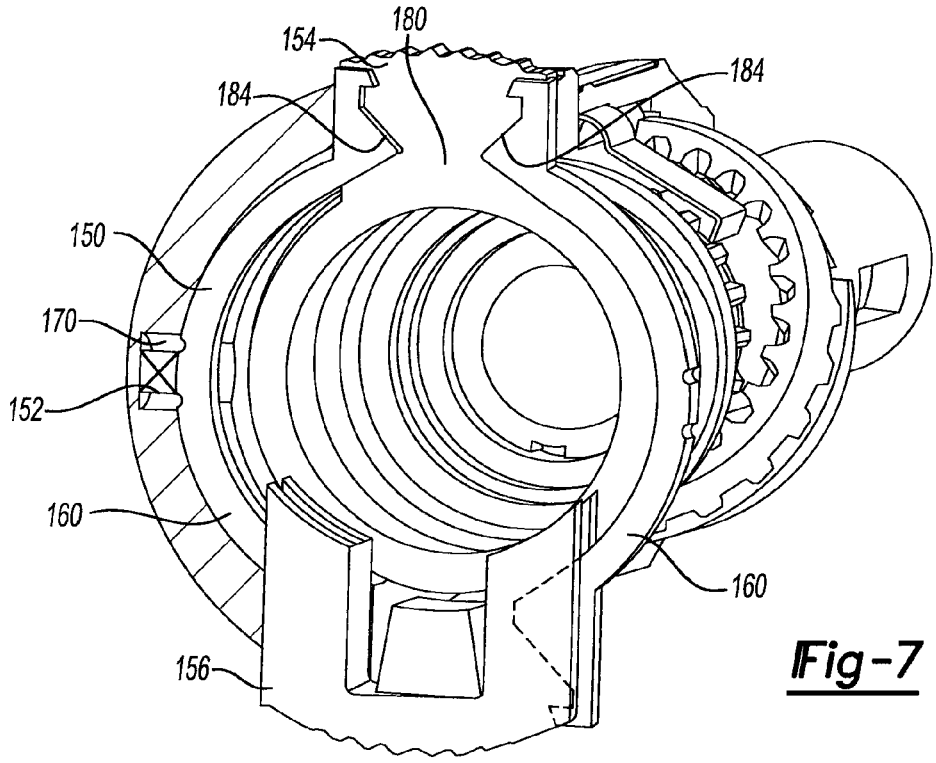

With reference to FIGS. 3, 4 and 6, the retaining mechanism 80 can be configured to cooperate with the first attachment member 54 on the driving tool 12 to retain the contact trip assembly 14 to the driving tool 12. In the example provided, the retaining mechanism 80 comprises a pair of retaining clips 150, a second biasing spring 152 (shown in FIG. 6), a first release button 154 and a second release button 156. Each of the retaining clips 150 can have a semi-circular clip body 160, which is configured to be received in the circumferentially extending groove 60 in the gear case 40, and a pair of clip tabs 162 that are coupled to the opposite ends of the clip body 160. The retaining clips 150 can be received through clip apertures 166 formed in the mount 90 of the contact trip housing 70 such that the clip bodies 160 are received within the mount cavity 98 and the clip tabs 162 extend outwardly from the clip apertures 166. The second biasing spring 152 can be a spring, such as a compression spring, that can be received in a spring pocket 170 (shown in FIG. 6) formed in contact trip housing 70 and compressed between the contact trip housing 70 and one of the clip bodies 160 to bias the clip body 160 toward the other clip body 160. The first and second release buttons 154 and 156 can be coupled to opposite pairs of the clip tabs 162. The first and second release buttons 154 and 156 can be configured with a generally V-shaped cam 180 (shown in detail only on the first release button 154 in FIG. 6) that can abut follower surfaces 184 formed on the clip tabs 162. Movement of the V-shaped cams 180 of the first and second release buttons 154 and 156 in a radially inwardly direction as shown in FIG. 7 spreads the follower surfaces 184 apart from one another. It will be appreciated that the spreading of the follower surfaces 184 apart from one another causes a corresponding spreading apart of the clip bodies 160 such that the clip bodies 160 can be received over the stem structure 58 (FIG. 4). When the first and second release buttons 154 and 156 are released, the second biasing spring 152 will urge the retaining clips 150 toward one another such that the clip bodies 160 can be at least partially received in the circumferentially extending groove 60 in the contact trip housing 70 as shown in FIG. 6 to thereby retain the contact trip assembly 14 to the driving tool 12.

Returning to FIGS. 3 and 4, the means 82 for adjusting the position of the nose element 72 relative to the sensor structure 74 can comprise a first rotary adjustment member 200, a second rotary adjustment member 202, a mounting block 204, a retainer 206, a detent spring 208, an adjustment collar 210, and a retaining clip 212 (shown in FIG. 4).

The first rotary adjustment member 200 can be an annular structure having an end face 220, a plurality of second threads 222 and a plurality of longitudinally extending teeth 224. The end face 220 can be abutted against the first abutting face 134 of the sensor body 120. The second threads 222 can be threadably engaged to the first threads 110 formed on the proximal end of the nose element 72. While the first and second threads 110 and 222 are depicted in the example provided as being external and internal threads, respectively, it will be appreciated that in the alternative, the first threads 110 could be internal threads and the second threads 222 could be external threads. The longitudinally extending teeth 224 can be spaced about the circumference of the first rotary adjustment member 200 and can extend generally parallel to an axis 230 that is coincident with a longitudinal axis of the nose element 72 and a rotational axis of the output spindle 28 of the driving tool 12. A portion of the longitudinally extending teeth 224 can be visible through an engagement aperture 232 formed through the barrel 92.

The mounting block 204 can be co-formed with the contact trip housing 70 and can comprise a first annular support surface 250 that can be disposed in a plane (not specifically shown) that intersects the axis 230 at an acute included angle 252. In the particular example provided, the acute included angle 252 has a magnitude of about 45 degrees, but it will be appreciated that the magnitude of the acute included angle 252 can be larger or smaller than that which is depicted here.

The second rotary adjustment member 202 can comprise an annular body having a rear abutting face 260, a beveled side wall 262, a plurality of internal teeth 264 and a plurality of external teeth 266. The rear abutting face 260 can be configured to abut the first annular support surface 250 formed on the mounting block 204 such that the second rotary adjustment member 202 is disposed at the acute included angle 252. The plurality of internal teeth 264 can be received into the engagement aperture 232 and can be meshingly engaged with the longitudinally extending teeth 224 of the first rotary adjustment member 200 in a manner that permits the first rotary adjustment member 200 to reciprocate along the axis 230 while maintaining meshing engagement between the internal teeth 264 and the longitudinally extending teeth 224. The external teeth 266 can have a configuration that is similar to a bevel gear and can extend from the annular body on a side opposite the rear abutting face 260. The crests of the external teeth 266 can cooperate to define a front abutting face 112.

The retainer 206 can be a generally U-shaped component that can comprise a second annular support surface 270, an annular interior surface 272 and an annular exterior surface 274. The second annular support surface 270 can be configured to abut the crests of the external teeth 266 of the second rotary adjustment member 202. The annular interior surface 272 can be configured to abut the exterior surface of the barrel 92. The annular interior surface 272 and the barrel 92 can be configured so as to resist rotation of the retainer 206 relative to the contact trip housing 70. In the particular example provided, the annular interior surface 272 defines a key member 280 that can be received in a recess (not specifically shown) in the exterior surface of the barrel 92 to inhibit rotation of the retainer 206 relative to the barrel 92.

The adjustment collar 210 can be an annular shell-like structure that can be received over the mounting block 204, the second rotary adjustment member 202 and a portion of the barrel 92 and can comprise a plurality of adjustment teeth 290, a first annular wall member 292, a second annular wall member 294 and a plurality of detent teeth 296. The first annular wall member 292 can abut the exterior surface of the barrel 92 such that the barrel 92 can support the adjustment collar 210 for rotation about the axis 230. The second annular wall member 294 can be disposed concentric with the first annular wall member 292 and can abut a portion of the beveled side wall 262 of the second rotary adjustment member 202. The plurality of adjustment teeth 290 can be configured to meshingly engage a portion of the external teeth 266 formed on the second rotary adjustment member 202 at a location proximate a forward end of the mounting block 204. Due to the sloped orientation of the second rotary adjustment member 202, the location at which the adjustment teeth 290 meshingly engage the external teeth 266 is disposed approximately 180 degrees away from a location at which the internal teeth 264 of the second rotary adjustment member 202 meshingly engage the longitudinally extending teeth 224 of the first rotary adjustment member 200. The annular exterior surface 274 of the retainer 206 can abut an interior circumferential surface of the adjustment collar 210 (e.g., the second annular wall member 294). The retaining clip 212 (FIG. 4) can be received into a circumferentially extending groove 300 formed in the barrel 92 and can limit forward movement of the adjustment collar 210 on the barrel 92 to thereby couple the adjustment collar 210 to the contact trip housing 70 in a manner that permits relative rotation but inhibits relative axial movement therebetween.

The detent spring 208 can be a leaf spring that can comprise opposed detent tabs that can be engaged to the first rotary adjustment member 200 and the adjustment collar 210 to resist relative rotation therebetween. In the particular example provided, the detent spring 208 is generally V-shaped, having a center detent tab 310 and a pair of distal detent tabs 312. The center detent tab 310 can be disposed at the vertex of the V-shaped leaf spring and can be configured to engage the adjustment teeth 290 on the adjustment collar 210. The distal detent tabs 312 can be disposed at the opposite ends of the V-shaped leaf spring and can be received through a detent spring aperture 320 formed in the contact trip housing 70. The distal detent tabs 312 can be configured to engage the longitudinally extending teeth 224 formed on the first rotary adjustment member 200. Rotation of the adjustment collar 210 by a user (to adjust a depth setting of the contact trip assembly 14) can cause the adjustment teeth 290 to urge the center detent tab 310 in a radially inward direction, which can deflect the distal detent tabs 312 radially outwardly away from the first rotary adjustment member 200 so as to disengage the longitudinally extending teeth 224 and permit rotation of the first rotary adjustment member 200 relative to the contact trip housing 70. Alignment of the center detent tab 310 to a valley (not specifically shown) between adjacent adjustment teeth 290 permits the distal detent tabs 312 to deflect radially inwardly toward the first rotary adjustment member 200 so as to engage the longitudinally extending teeth 224 and resist rotation of the first rotary adjustment member 200 relative to the contact trip housing 70.

Operation of Screwing Tool 10

With reference to FIGS. 1 and 2A, a driving bit 400, such as a Phillips, Phillips ACR, Torx, Scrulox, Hex, Pozidriv, or Pozidriv ACR bit, can be coupled to the output spindle 28 of the driving tool 12. In the particular example provided, the driving bit 400 is coupled to a magnetic bit holder 402 that is secured to the output spindle 28 via the chuck 30. It will be appreciated, however, that the driving bit 400 could be configured with an extended length that permits the driving bit 400 to be coupled to the output spindle 28 without the use of a separate bit holder.

The contact trip assembly 14 can be received over the stem structure 58 such that the driving bit 400 is received through the contact trip housing 70 and into the nose element 72. The contact trip housing 70 can be mounted to the mounting stem 52 as described in detail above. Briefly, the first and second release buttons 154 and 156 can be urged radially inwardly to move the retaining clips 150 (FIG. 3) outwardly, the mount 90 of the contact trip housing 70 can be received over the stem structure 58 such that the retaining clips 150 (FIG. 3) are aligned to the groove 60, and the first and second release buttons 154 and 156 can be released to permit the second biasing spring 152 (FIG. 6) to urge the retaining clips 150 (FIG. 3) at least partly into the groove 60 to thereby fix the contact trip housing 70 to the gear case 40 in an axial direction. As also noted above, the mount 90 of the contact trip housing 70 can be configured to engage the gear case 40 such that the contact trip housing 70 is disposed and maintained relative to the gear case 40 in a predetermined orientation.

Figure 5:
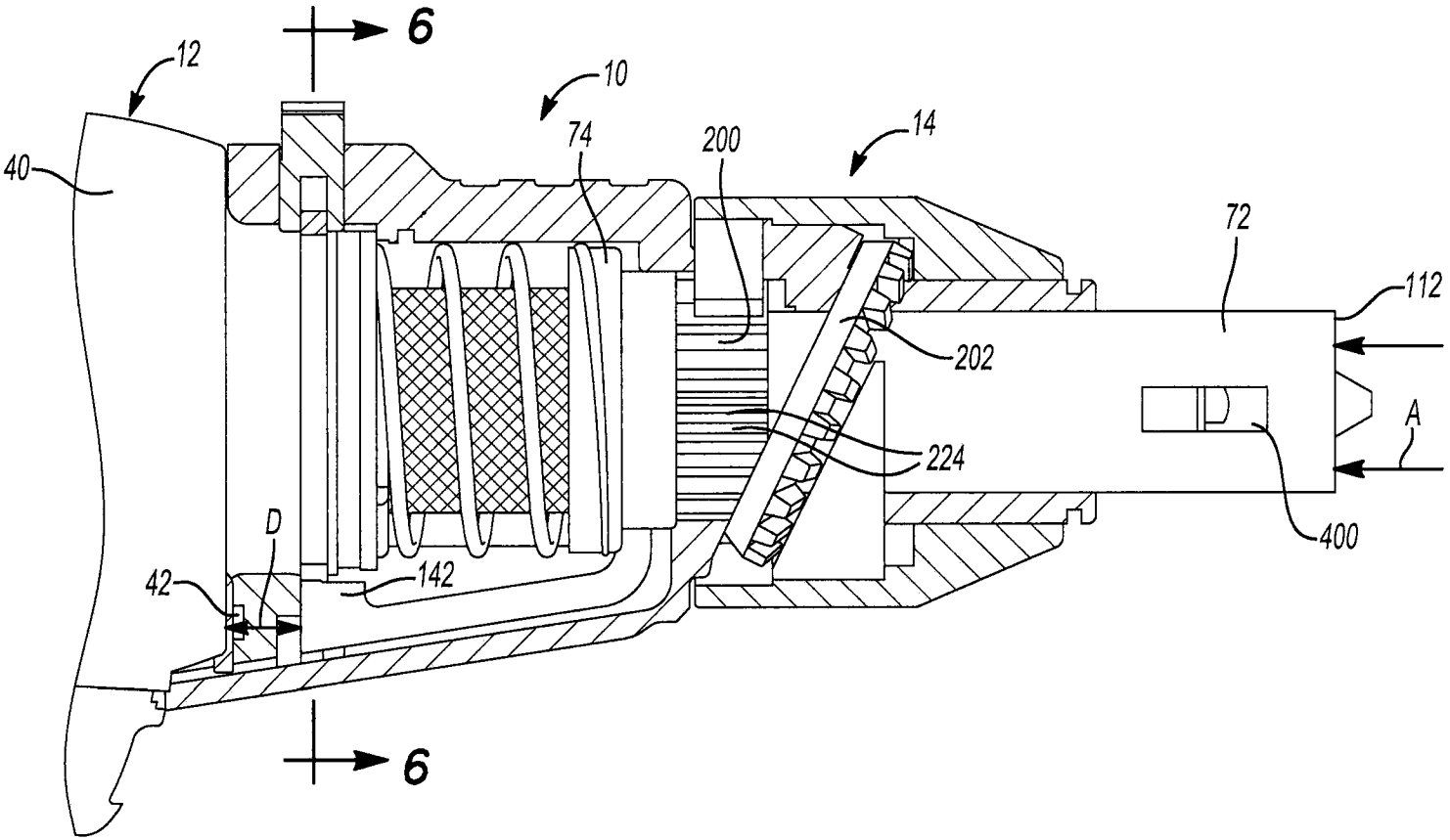

With reference to FIG. 4, the driving bit 400 can be engaged to the head (not shown) of a threaded fastener (not shown) that is to be installed (driven) into a desired surface (not shown) of a workpiece (not shown). The abutting face 112 of the nose element 72 can be (initially) spaced apart from the desired surface of the workpiece. The driving tool 12 can be operated (i.e., via the trigger assembly 38 (FIG. 2A)) to rotate the driving bit 400 to turn the threaded fastener such that the threaded fastener is threaded into the workpiece. It will be appreciated that the abutting face 112 of the nose element 72 will approach and contact that the surface of the workpiece as the threaded fastener is threaded into the workpiece and that continued rotation of the driving bit 400 after contact is established between the abutting face 112 and the surface of the workpiece, the nose element 72 will be driven axially into the barrel 92 in the direction of arrows A in FIG. 5. Movement of the nose element 72 in this manner will cause corresponding axial movement of the first rotary adjustment member 200 toward the gear case 40; it will be appreciated, however, that the longitudinally extending teeth 224 on the first rotary adjustment member 200 will remain in meshing engagement with the internal teeth 264 (FIG. 3) of the second rotary adjustment member 202 despite the axial movement of the first rotary adjustment member 200 relative to the second rotary adjustment member 202 as described above. Such movement of the first rotary adjustment member 200 will correspondingly cause rearward axial movement of the sensor structure 74 (against the bias of the first biasing spring 76) such that a distance D between the sensor target 142 and the sensor 42 decreases. When the distance between the sensor target 142 and the sensor 42 decreases to a predetermined point that causes the sensor 42 to generate the sensor signal (i.e., when the threaded fastener has been driven to a depth to which the contact trip assembly 14 has been preset), the controller 44 (FIG. 2A) is configured to interrupt the operation of the motor assembly 22 (FIG. 2A) to halt the rotation of the driving bit 400.

It will be appreciated that in some instances, it may be beneficial to permit the driving tool 12 to be operated in one or more rotational directions despite the positioning of the sensor target 142 at a distance that is less than or equal to the predetermined distance that is employed to cause the sensor 42 to generate the sensor signal. Accordingly, the driving tool 12 could include a switch that can be employed by the operator of the screwdriving tool 10 to cause the driving tool 12 to rotate in one or more rotational directions regardless of the position of the sensor target 142 relative to the sensor 42.

A relatively common situation may simply involve instances where the operator of the screwdriving tool 10 wishes to loosen a fastener that has been driven to the desired depth. In such situations, the driving tool 12 may be equipped with a direction sensor (not shown) that can be configured to sense a position of a motor direction switch 500 (FIG. 2A) and generate a direction signal in response thereto. The controller 44 (FIG. 2A) can receive the direction signal and can permit operation of the motor assembly 22 (FIG. 2A) in instances where the sensor signal is generated by the sensor 42 but the direction signal generated by the direction sensor is indicative of the placement of the direction switch 500 (FIG. 2A) in a predetermined position (e.g., a position that corresponds to operation of the motor assembly 22 (FIG. 2A) in a reverse direction).

Figure 2B:
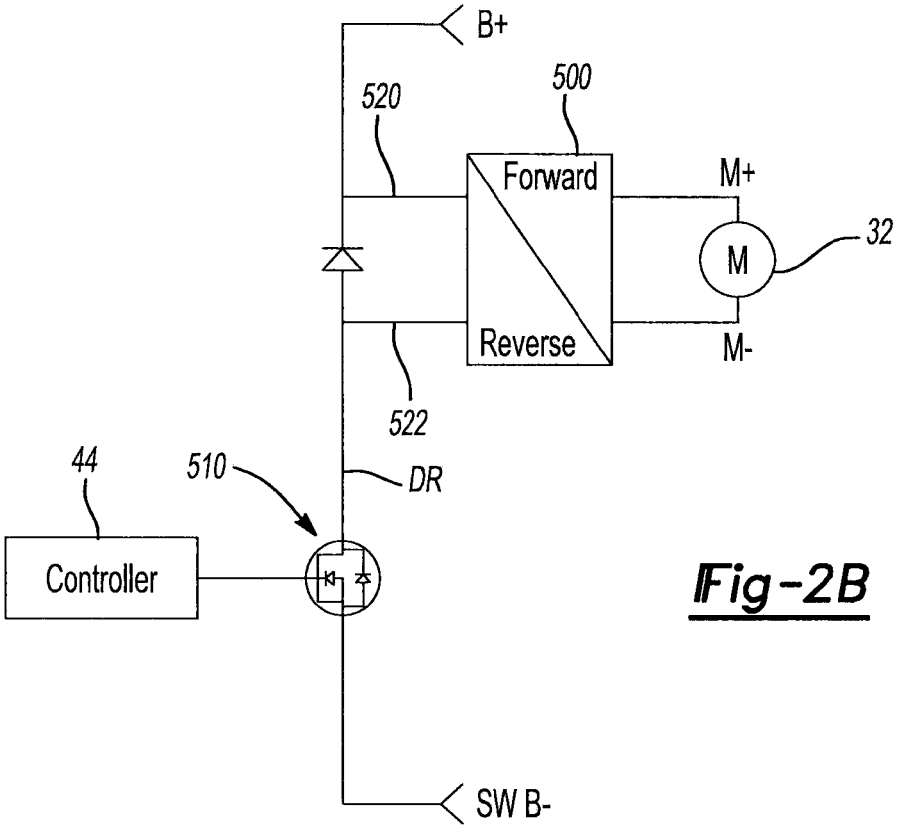
FIG. 2B is a schematic illustration of a portion of the screwdriving tool of FIG. 1 illustrating a portion of a motor control circuit.

It is relatively common for modern driving tools with brushed electric motors to control the operation of the motor through a pulse width modulated (PWM) signal that operates one or more field effect transistors as is shown in FIG. 2B. In the example provided, the controller 44, which may include a 555 timer or a microprocessor, for example, can provide the PWM signal to the field effect transistor(s) 510 that can be based entirely on a position of a trigger 512 (FIG. 1) (i.e., the PWM signal can be determined independently and irrespective of the setting of the motor direction switch 500). In such tools, it is relatively common for the motor direction switch 500 to control the rotation of the motor 32 by controlling the electrical connection of the brushes M+ and M− of the motor 32, a first terminal 520 that is associated with a positive supply voltage and a second terminal 522 that is coupled to the drain DR of the field effect transistor(s) 510. Stated another way, the electrical coupling of the brush M+ to the first terminal 520 and the brush M− to the second terminal 522 will cause the motor 32 to rotate in a first rotational direction, while the electrical coupling of the brush M+ to the second terminal 522 and the brush M− to the first terminal 520 will cause the motor 32 to rotate in a second, opposite rotational direction.

Figure 2C:
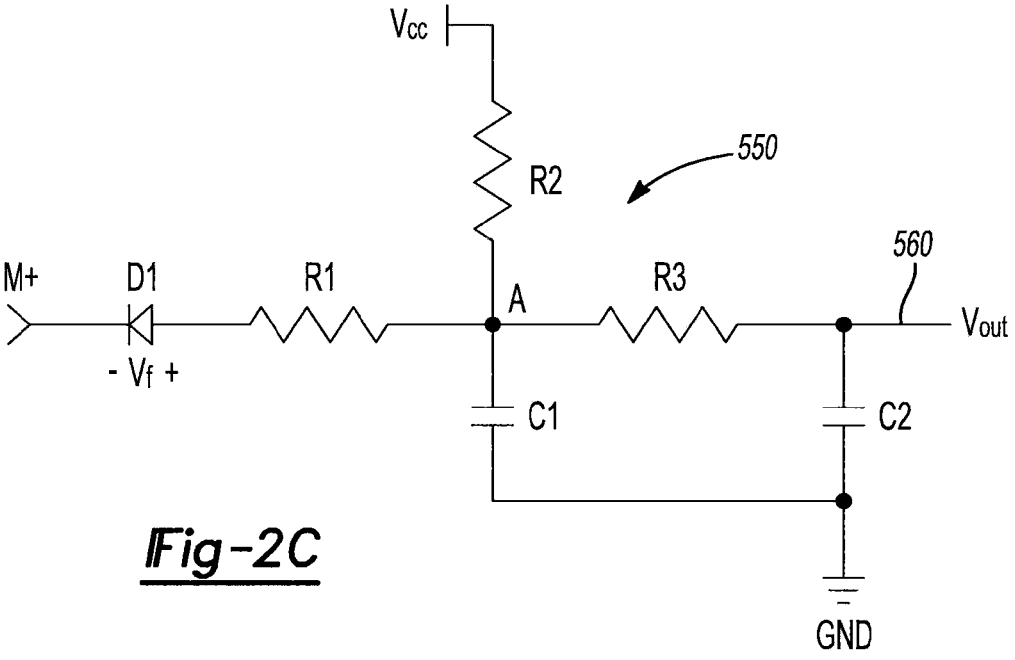
FIG. 2C is a schematic illustration of a portion of the screwdriving tool of FIG. 1 illustrating a circuit for detecting the rotational direction of the motor assembly.

In instances where it is desirable to know the direction in which the motor 32 is to be operated (e.g., where depth sensing is employed and/or where the diving tool includes an electronically-controlled torque clutch) so that the operation of the motor 32 may be inhibited in some situations (e.g., upon sensing that a fastener has been installed to a preset depth or to a desired torque when the motor 32 is rotating in the first rotational direction) but permitted in other situations (e.g., the sensing that a fastener has been installed to a preset depth or to a desired torque when the motor 32 is rotating in the second rotational direction), the controller 44 may include a circuit that senses the setting of the motor direction switch 500 by monitoring the voltage at one of the brushes (e.g., the brush M+), such as the exemplary circuit 550 that is depicted in FIG. 2C. The circuit 550 can comprise a diode D1, a first resistor R1, a second resistor R2, a third resistor R3, a first capacitor C1 and a second capacitor C2. The diode D1 and the first resistor R1 can be coupled in series between the brush M+ and a node A, with the first resistor R1 being disposed between the diode D1 and the node A. The second resistor R2 can be coupled in series between the node A and control voltage source Vcc. The third resistor R3 can be coupled in series between the node A and an output terminal 560 of the circuit 550. The second capacitor C2 can be coupled between the output terminal 560 of the circuit 550 (at a point between the third resistor R3 and the output terminal 560) and an electric ground GND. The first capacitor C1 can be coupled to the node A and the grounded side of the second capacitor C2.

When the motor direction switch 500 couples the brush M+ to a positive voltage (so that the motor 32 operates in the first direction), the diode D1 does not conduct electricity between the brush M+ and the output terminal 560 and consequently, the voltage at the output terminal 560 corresponds to the voltage of the control voltage source Vcc.

With additional reference to FIG. 2B, when the motor direction switch 500 couples the brush M+ to the drain D of the field effect transistor(s) 510, the voltage at the brush M+ will depend upon the state of the field effect transistor(s) 510, while the filtered voltage at the output terminal 560 will be near ground. When the field effect transistor(s) are "on", the diode D1 will conduct electricity (to thereby permit current to flow from the control voltage source Vcc to an electrical ground through the control FET) such that the voltage at node A will drop to a voltage that is approximately equal to Vf (assuming that the magnitude of the first resistor R1 is much less than the magnitude of the second resistor R2). When the field effect transistor(s) are "off", the diode D1 will cease conducting electricity, which causes the voltage at node A to raise to the voltage of the control voltage source Vcc. The first and second resistors R1 and R2 and the first capacitor C1 can control the speed at which the voltage at the node A changes in this mode. Assuming the use of a PWM signal with a frequency of about 8 kHz (such that one PWM cycle has a duration of 125 us; with a 10% duty cycle, the length of time the cathode of diode D1 will be pulled low is 12.5 us) and that the duty cycle of the PWM signal can be as low as 10%, the first capacitor C1 can have a value of 100 nF (so as to discharge relatively quickly when the cathode of the diode D1 is pulled to a low electrical state), the first resistor R1 can have a value of 22 ohms (which provides a time constant of 2.2 us, which is much less than the 12.5 us that the diode D1 is conducting so that the first capacitor C1 will be permitted to discharge completely) and the second resistor R2 can have a value of 100 k ohms (which provides a time constant of 10 ms, which is much longer than the 112 us that the field effect transistor(s) 510 will be off so that node A will never be permitted to recharge before the next PWM pulse discharges the first capacitor C1). The third resistor R3 and the second capacitor C2 can form a secondary low-pass filter to further smooth-out the voltage at the output terminal 560.

It will be appreciated that the voltage at the output terminal 560 can be employed to directly control a field effect transistor (not shown) or be read by a microprocessor or other type of controller to determine the state of the motor direction switch 500.

We note that the field effect transistor(s) 510 must be "on" for a certain amount of time to be able to sense the setting or position of the motor direction switch 500. In this regard, the setting cannot be sensed by the circuit 550 unless some current flows through the motor 32. Also, since the third resistor R3 and the first capacitor have a time constant (approximately 10 ms in the example provided), the voltage at the output terminal 560 may not accurately represent the state or position of the motor direction switch 500 for a predetermined length of time, such as approximately 20 ms. We suggest that immediately after the trigger 512 (FIG. 1) is depressed to operate the motor 32, the controller 44 be configured to output a low duty cycle signal to the motor 32 for a predetermined length of time (e.g., 20 ms) which is too low to cause the motor 32 to rotate but high enough to permit the circuit 550 to properly function. The predetermined length of time is relatively short and would not be perceived by the operator of the driving tool 12 (FIG. 1). Moreover, the trigger assembly 38 (FIG. 2A) can be configured to prevent the switching of the motor direction switch 500 once the trigger 512 (FIG. 1) has been depressed so that voltage at the output terminal 560 will remain valid and accurate until the trigger 512 (FIG. 1) is released.

Figure 20:
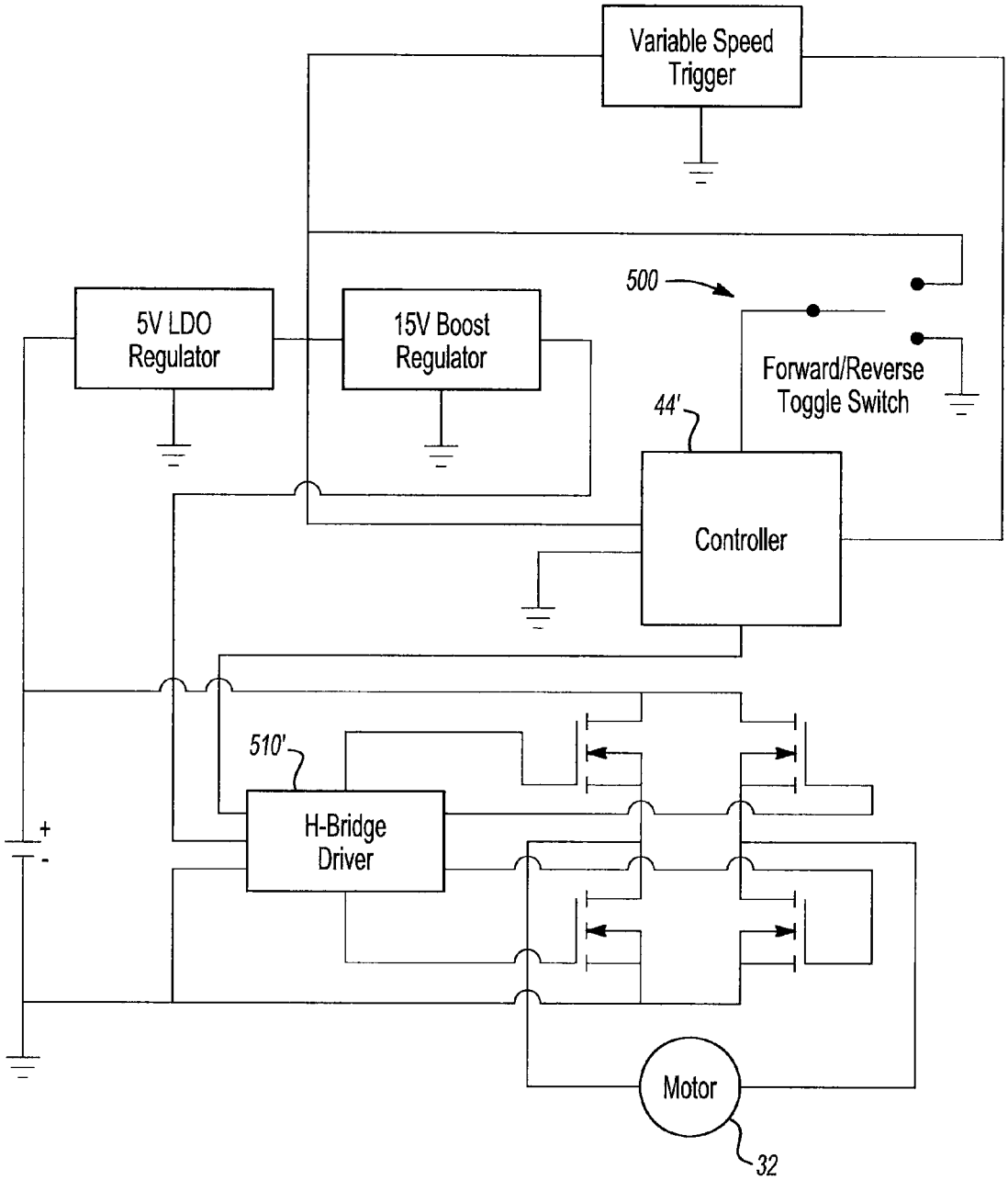
FIG. 20 depicts an alternate means for controlling a rotational direction of the motor of the screwdriving tool of any of the examples of the present disclosure.

Another solution is depicted in FIG. 20 wherein the direction switch 500 is configured to provide the controller 44' with a digital signal indicative of the desired rotational direction of the motor 32. Based on the digital signal received from the direction switch 500, the controller 44' can control the rotational direction of the motor 32 by switching the field effect transistors in an appropriate H-bridge configuration.

Figure 8:
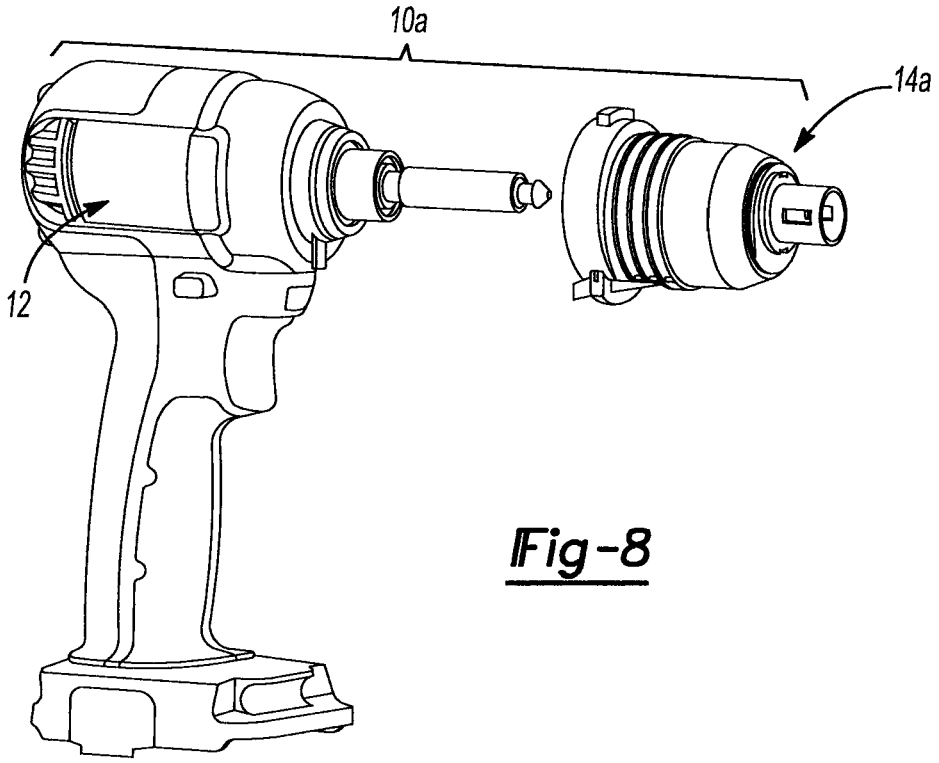
FIG. 8 is an exploded perspective view of a second screwdriving tool constructed in accordance with the teachings of the present disclosure.
Figure 9:
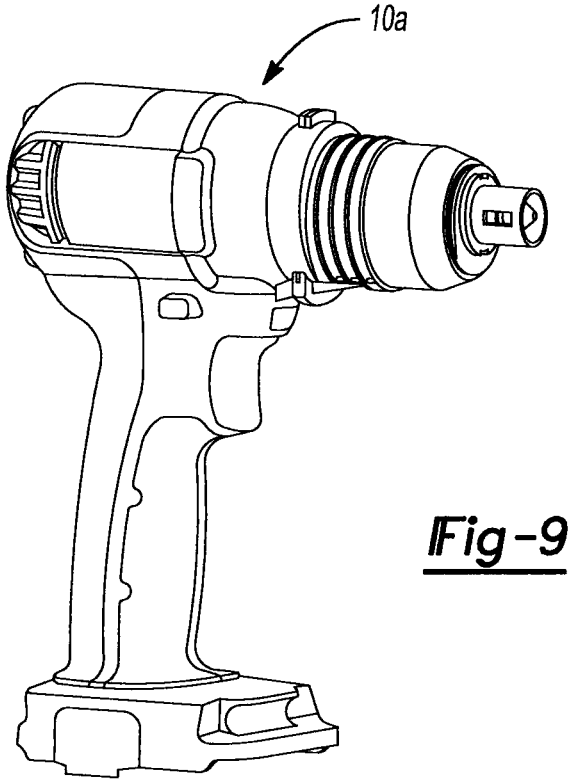
FIG. 9 is a perspective view of the screwdriving tool of FIG. 8.

With reference to FIGS. 8 and 9, a second screwdriving tool constructed in accordance with the teachings of the present disclosure is generally indicated by reference numeral 10*a*. The screwdriving tool 10*a* can comprise the driving tool 12 and a contact trip assembly 14*a* that can be removably coupled to the driving tool 12. Except as detailed herein, the contact trip assembly 14*a* can be generally similar to the contact trip assembly 14 (FIG. 1).

Figure 10:
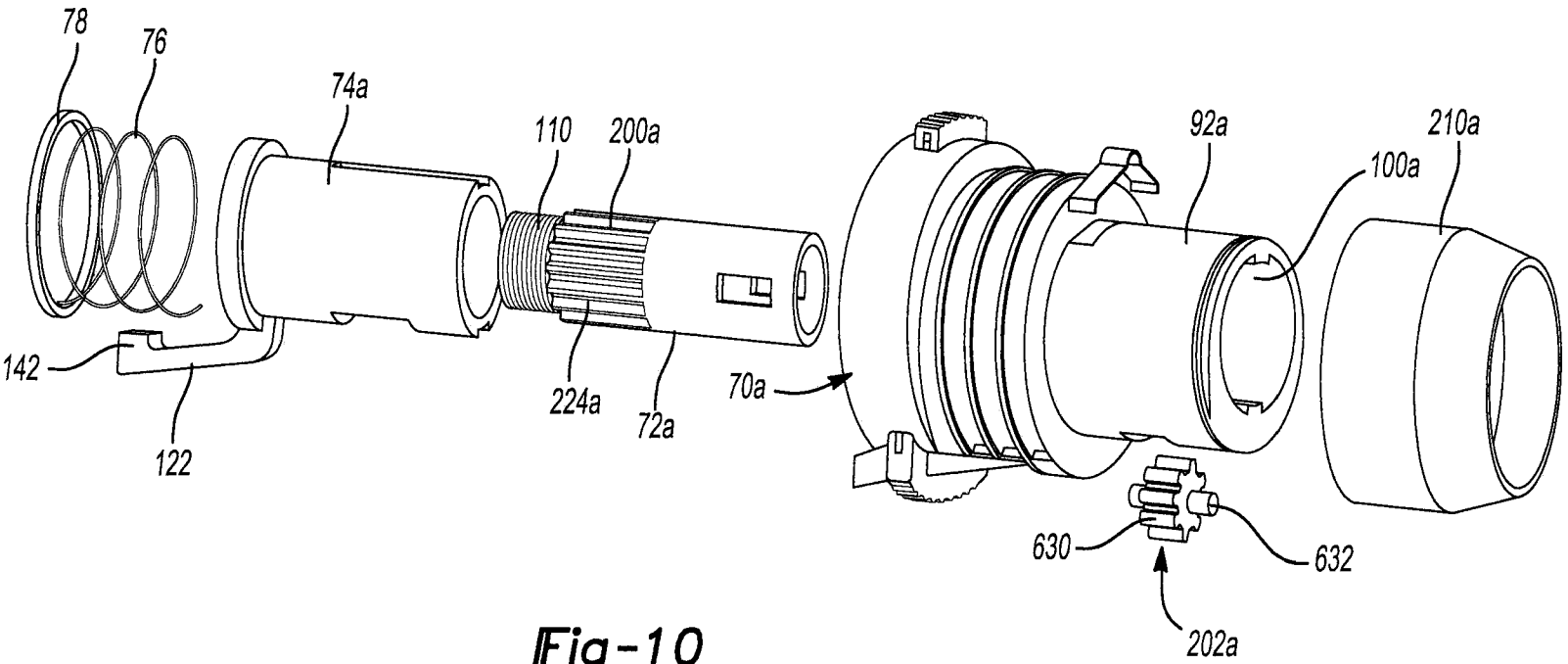
FIG. 10 is an exploded perspective view of a portion of the screwdriving tool of FIG. 8 illustrating the contact trip assembly in more detail.
Figure 11:
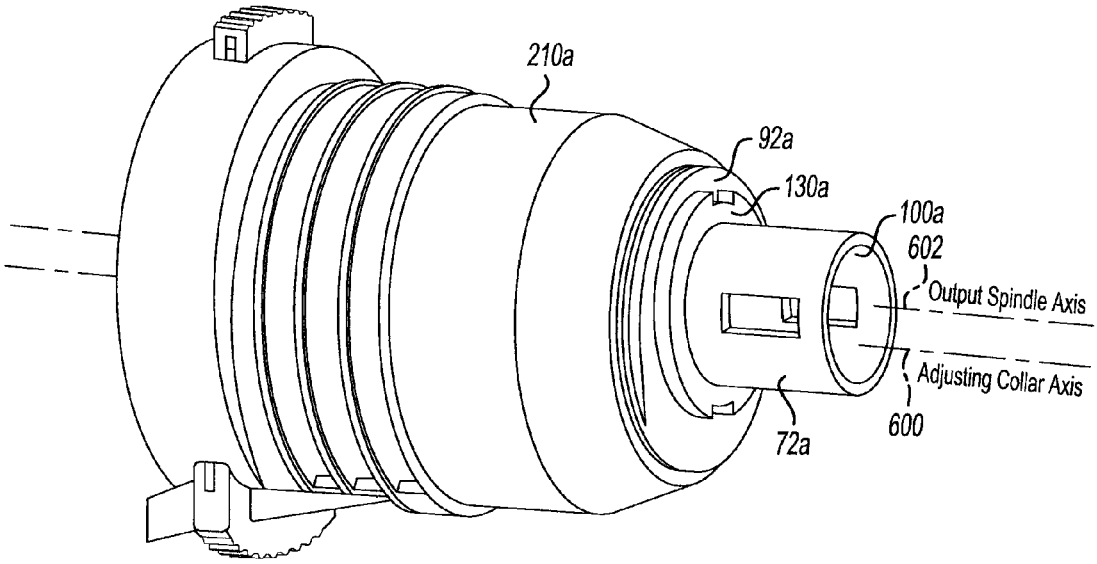
FIG. 11 is a perspective view of the contact trip assembly shown in FIG. 10.

With reference to FIGS. 8, 10 and 11, the barrel 92*a* of the contact trip housing 70*a* is shown to be disposed about an axis 600 that is offset from a rotational axis 602 of the output spindle 28 (FIG. 8) of the driving tool 12, while the barrel aperture 100*a* is disposed about an axis (not specifically shown) that is coincident with the rotational axis 602 of the output spindle 28 (FIG. 8).

Figure 12:
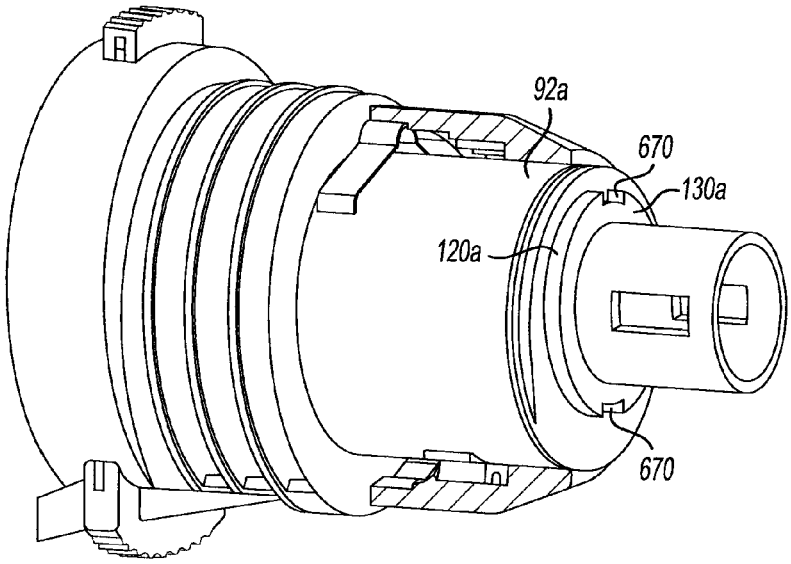
FIGS. 12 through 15 are perspective partly broken away or sectioned views of the contact trip assembly shown in FIG. 10.
Figure 13:
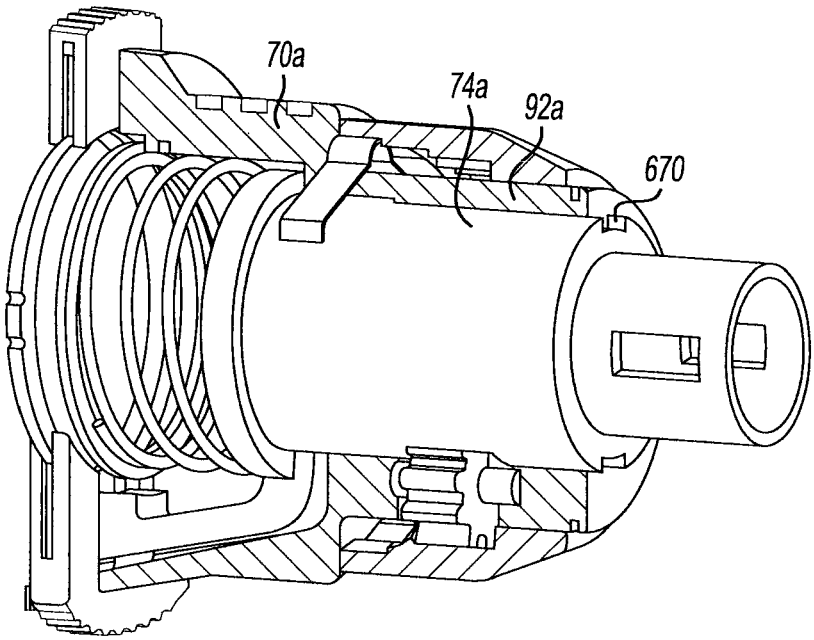
Figure 14:
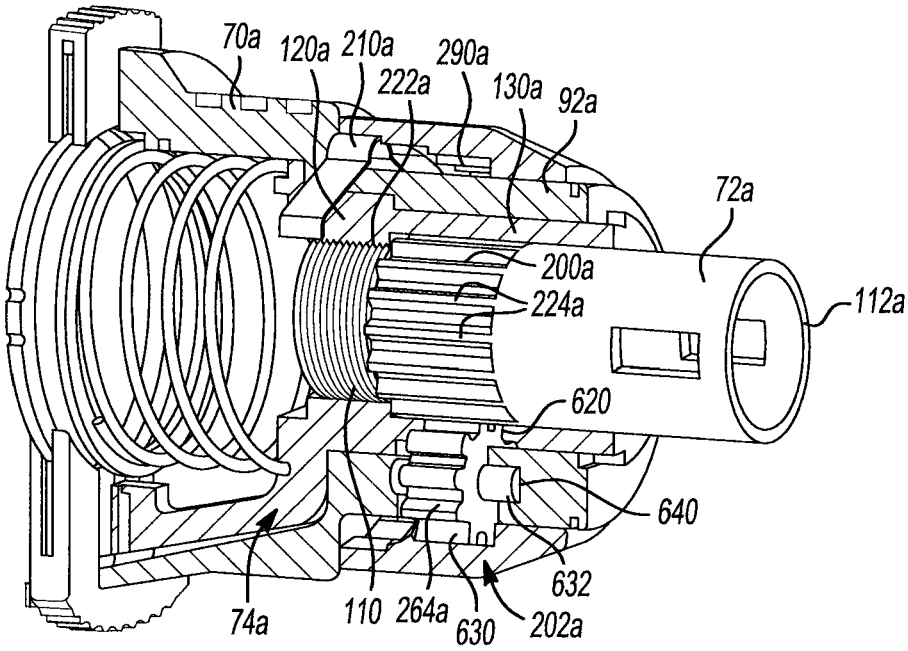
Figure 15:
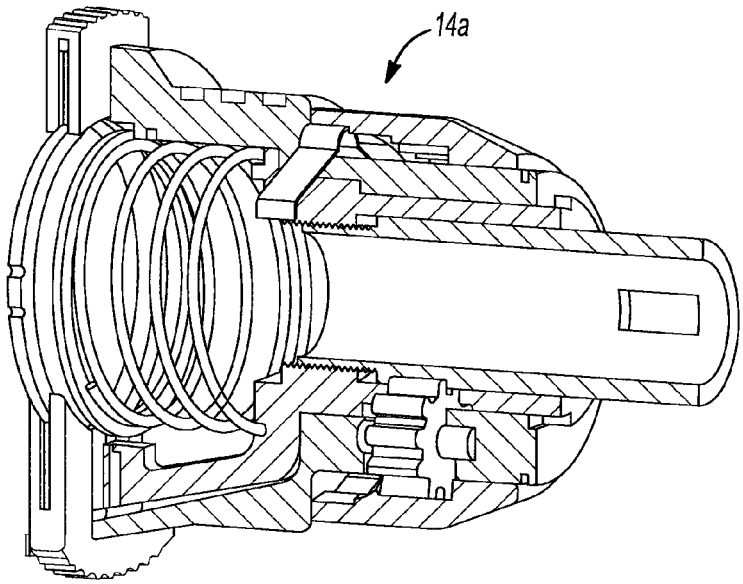
Figure 16:
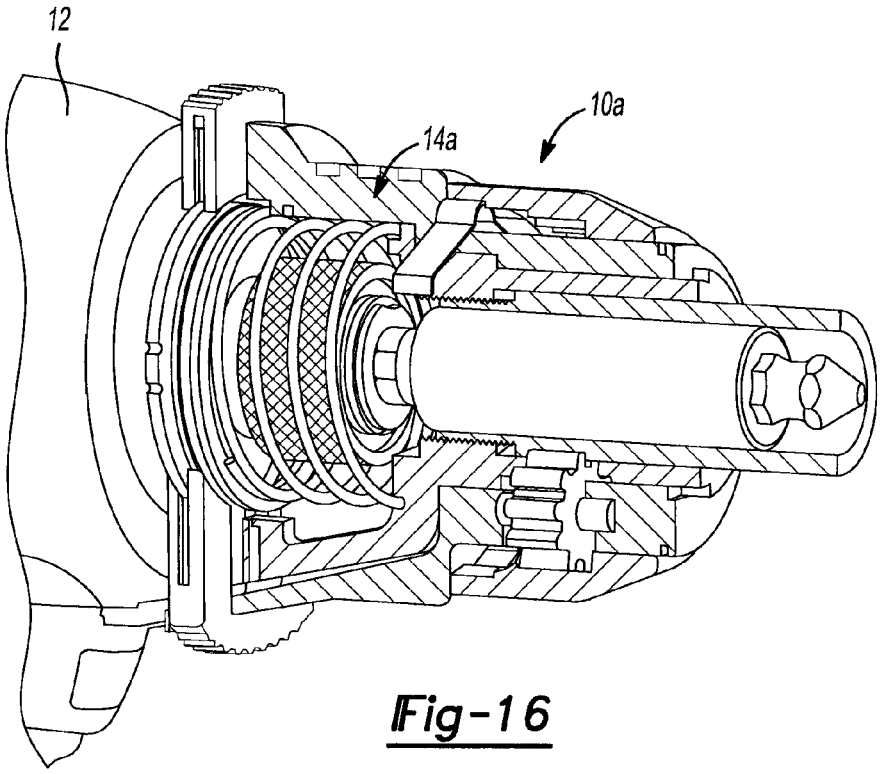
FIG. 16 is a longitudinal section view of a portion of the screwdriving tool of FIG. 8.
Figure 17:
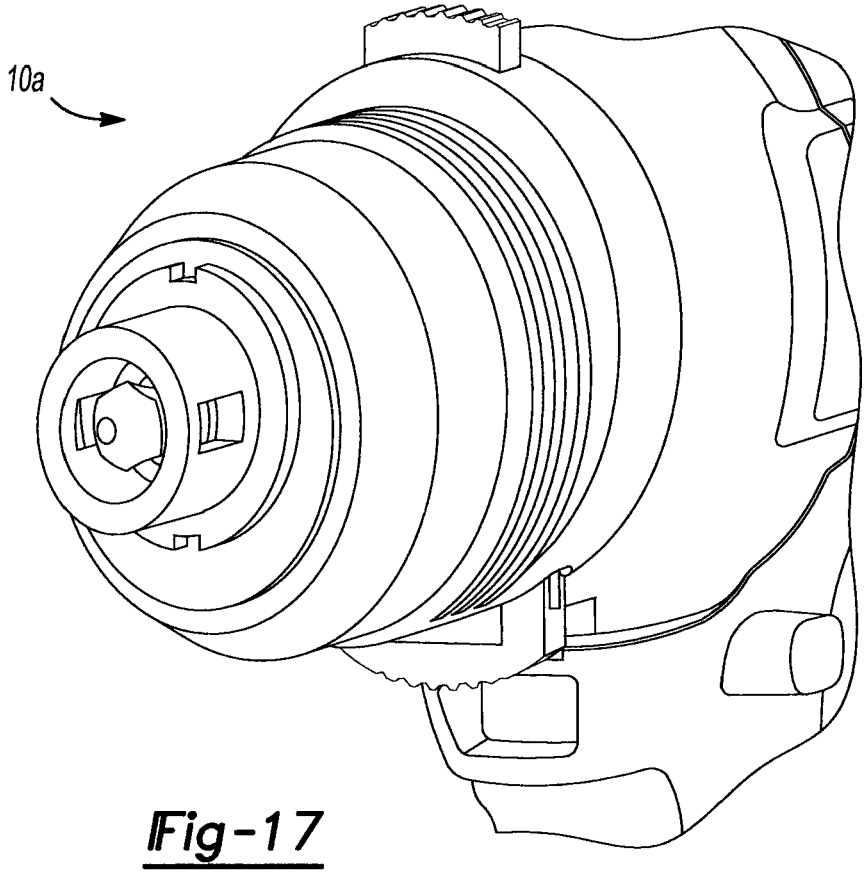
FIG. 17 is a perspective view of a portion of the screwdriving tool of FIG. 8.

With reference to FIGS. 10 and 14, the first rotary adjustment member 200*a* can be co-formed with the nose element 72*a*. More specifically, the longitudinally extending teeth 224*a* can be formed on or non-rotatably coupled to the nose element 72*a* between the abutting face 112*a* and the plurality of first threads 110. The second threads 222*a* can be formed in the sensor body 120*a* such that the nose element 72*a* is threadably engaged directly to the sensor structure 74*a*. The first annular portion 130*a* of the sensor body 120*a* can extend through the barrel 92*a* and can include an aperture 620 through which a portion of the second rotary adjustment member 202*a* may be received. The second rotary adjustment member 202*a* can comprise a pinion 630 that can be mounted on an axle 632 that is offset from the rotational axis of the output spindle 28 (FIG. 8). In the example provided, the axle 632 is mounted in an axle aperture 640 formed in the barrel 92*a* of the contact trip housing 70*a*. The second rotary adjustment member 202*a* can include straight teeth 264*a* that can be meshingly engaged with the longitudinally extending teeth 224*a* associated with the first rotary adjustment member 200*a*, as well as with the adjustment teeth 290*a* that are formed on the adjustment collar 210*a*. It will be appreciated that rotation of the adjustment collar 210*a* can cause corresponding rotation of the pinion 630, which can cause corresponding rotation of the first rotary adjustment member 200*a*/nose element 72*a* to thread the nose element 72*a* further into or out of the sensor body 120*a*. Stated another way, the adjustment teeth 290*a* can comprise a ring gear, the straight teeth 264*a* can comprise a planet gear, and the longitudinally extending teeth 224*a* can comprise a sun gear. It will also be appreciated that the sensor structure 74*a* can be non-rotatably but axially movably coupled to the contact trip housing 70*a* in any desired manner. In the particular example provided, longitudinally extending keyways 670, which are illustrated in FIGS. 12 and 13, are formed into the first annular portion 130*a* of the sensor body 120*a* and key members (not specifically shown), which are integrally formed with the barrel 92*a* are received into the keyways 670 to permit the sensor body 120*a* to translate axially within the contact trip housing 70*a* while inhibiting rotation between the sensor body 120*a* and the contact trip housing 70*a*.

Figure 18:
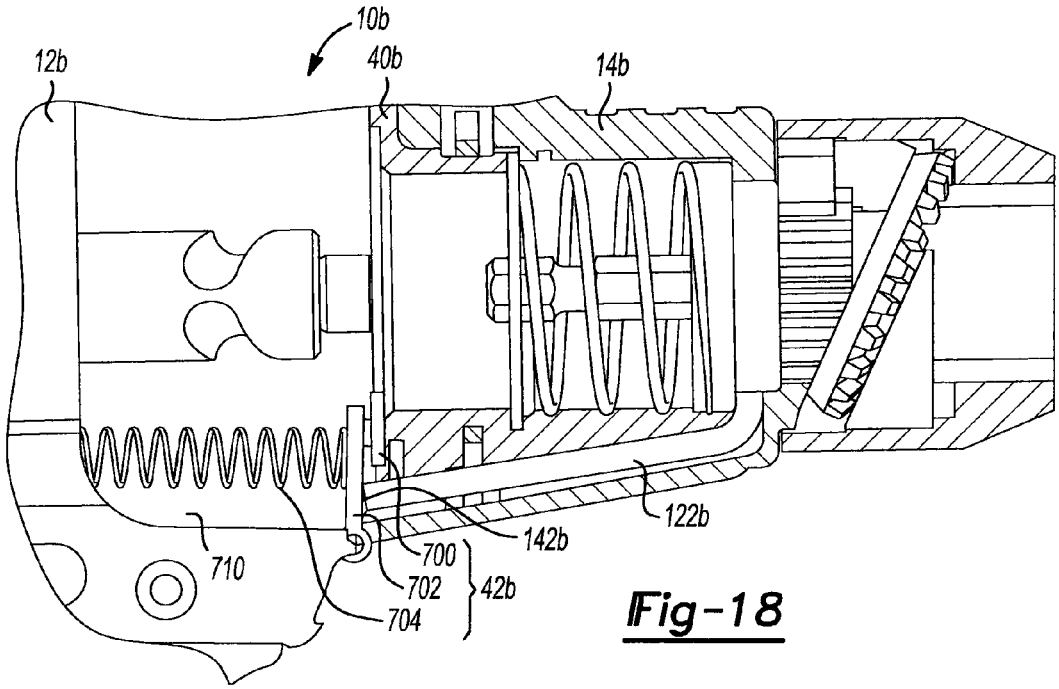
FIGS. 18 and 19 are longitudinal section views of a third screwdriving tool constructed in accordance with the teachings of the present disclosure.
Figure 19:
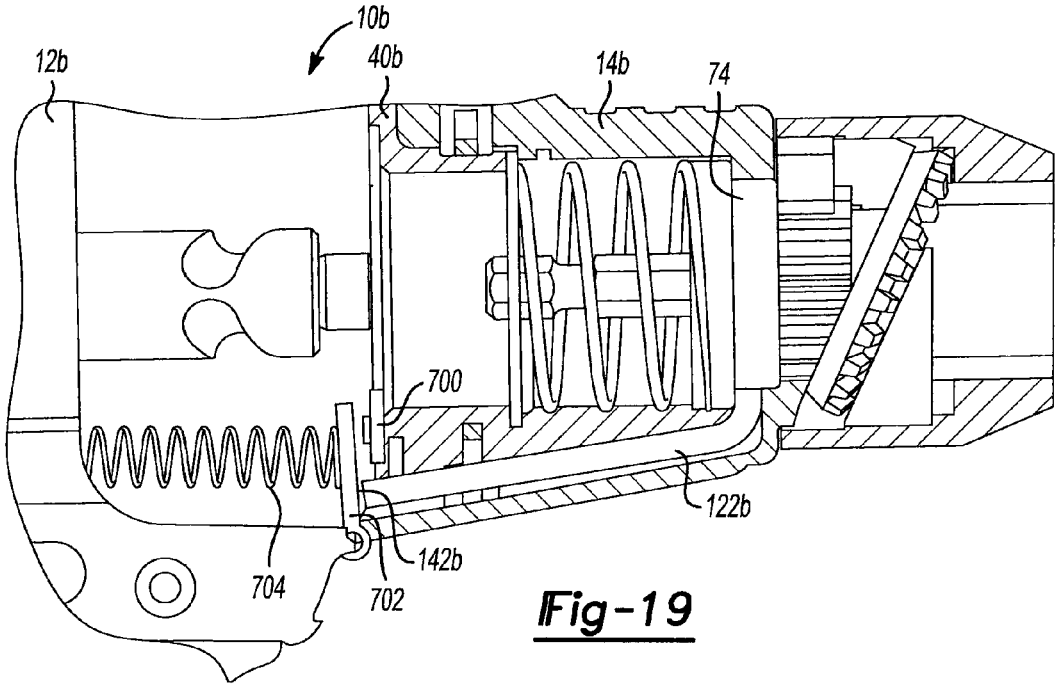

With reference to FIGS. 18 and 19, a third screwdriving tool constructed in accordance with the teachings of the present disclosure is generally indicated by reference numeral 10*b*. The screwdriving tool 10*b* can comprise a driving tool 12*b* and a contact trip assembly 14*b* that can be removably coupled to the driving tool 12*b*. Except as detailed herein, the driving tool 12*b* and the contact trip assembly 14*b* can be generally similar to the driving tool 12 and the contact trip assembly 14 of FIG. 1.

The driving tool 12*b* differs from the driving tool 12 (FIG. 1) in that the sensor 42*b* comprises a limit switch 700, a lever 702 and a lever return spring 704. The limit switch 700 can be any type of switch (e.g., a microswitch that may be toggled between a first state and a second state) and can be mounted to the gear case 40*b*. The lever 702 can be pivotally coupled to the gear case 40*b*. The lever return spring 704 can be received in a cavity 710 formed in the gear case 40*b* and can bias the lever 702 into engagement with the limit switch 700 such that the limit switch 700 is maintained in a first switch state.

The contact trip assembly 14*b* is identical to the contact trip assembly 14 (FIG. 1), except that the sensor target 142*b* need not be magnetic. In this regard, the sensor target 142*b* comprises an end face of the sensor arm 122*b* and is configured to physically contact and pivot the lever 702 to permit the limit switch 700 to change from the first switch state to a second switch state (and generate the sensor signal).

Figure 21:
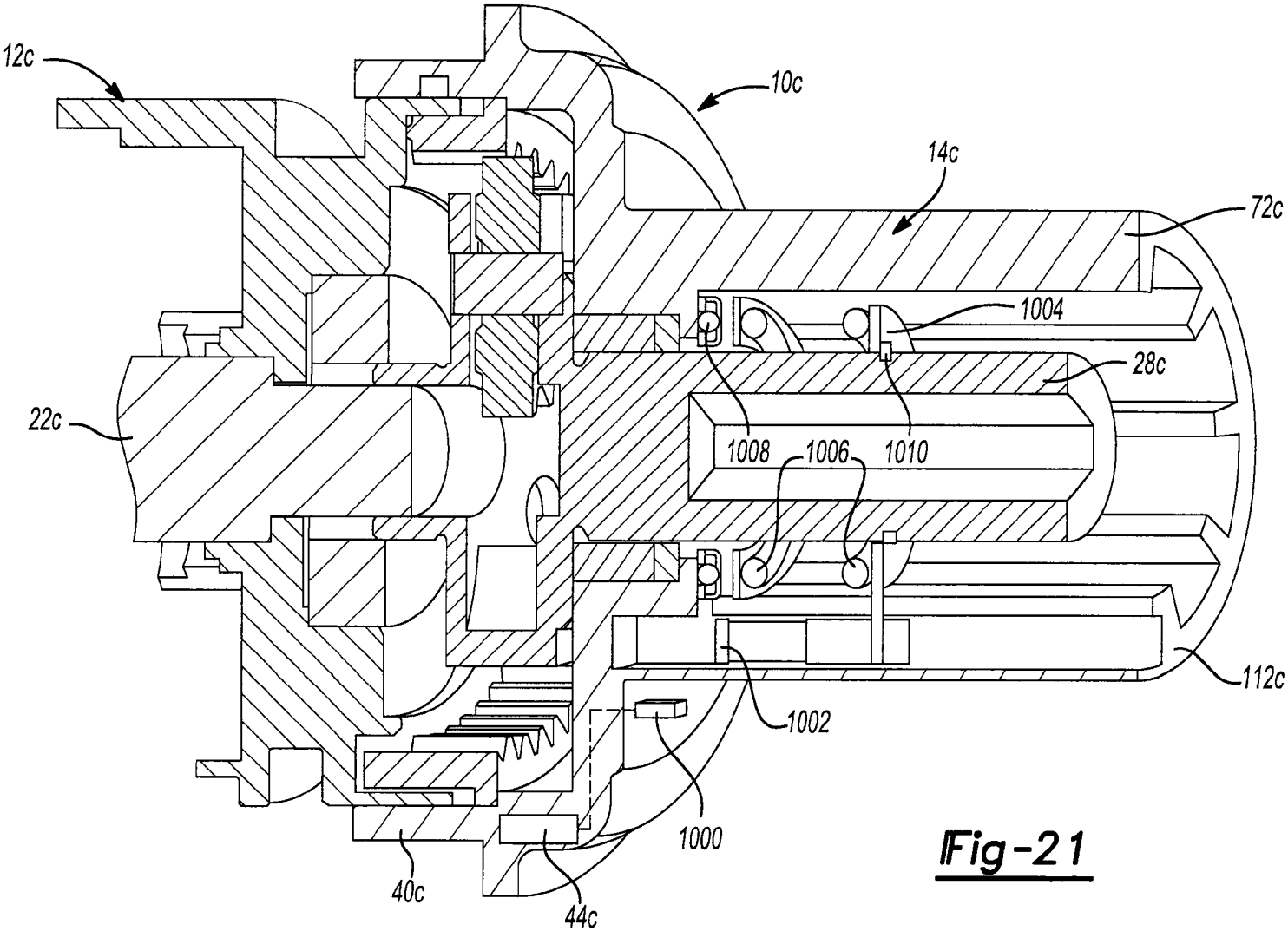
FIG. 21 is a longitudinal section view of a portion of a fourth screwdriving tool constructed in accordance with the teachings of the present disclosure.

Another screwdriving tool is generally indicated by reference numeral 10*c* in FIG. 21. In this example, portions of the contact trip assembly 14*c* are integrated into the driving tool 12*c*. More specifically, the contact trip assembly 14*c* can include a sensor 1000, a sensor target 1002, and a nose element 72*c* that can be integrally formed with the gear case 40*c* of the driving tool 12*c*. The sensor 1000 can be fixedly mounted to the gear case 40*c* and electrically coupled to the controller 44*c*. The sensor 1000 can comprise any type of sensor, such as a microswitch or a non-contact switch, such as a Hall-effect switch or magnetoresistive switch. The sensor target 1002 can comprise a structure that is configured to cooperate with the sensor 1000 to generate an appropriate sensor signal as will be described in more detail, below. In the particular example provided, the sensor 1000 is a linear Hall-effect sensor and the sensor target 1002 is a magnet that is mounted to a mounting ring 1004 that is mounted coaxially about the output spindle 28*c*. A spring 1006, which can extend between a thrust washer 1008 adjacent to the gear case 40*c* the mounting ring 1004, can bias the sensor target 1002 axially away from the sensor 1000. A retaining ring 1010 can be employed to limit movement of the mounting ring 1004 relative to the output spindle 28*c*.

The sensor 1000 can produce different signals depending on the location of the sensor target 1002. In the particular example provided, the sensor 1000 acts as a toggle switch to toggle between two states (e.g., off and on) depending on the position of the sensor target 1002 (relative to the sensor 1000). For example, when the sensor target 1002 is spaced apart from the sensor 1000 by a distance that is greater than or equal to a predetermined distance, the sensor 1000 can produce a first signal, and when the sensor target 1002 is spaced apart from the sensor 1000 by a distance that is less than the predetermined distance, the sensor can produce a second signal. The controller 44*c* can receive the first and second signals and can operate the motor assembly 22*c* according to a desired schedule. In the example illustrated, the controller 44*c* permits operation of the motor assembly 22*c* in a forward or driving direction only when the second signal is produced, and inhibits operation of the motor assembly 22*c* in a forward direction when the first signal is produced.

Figure 22:
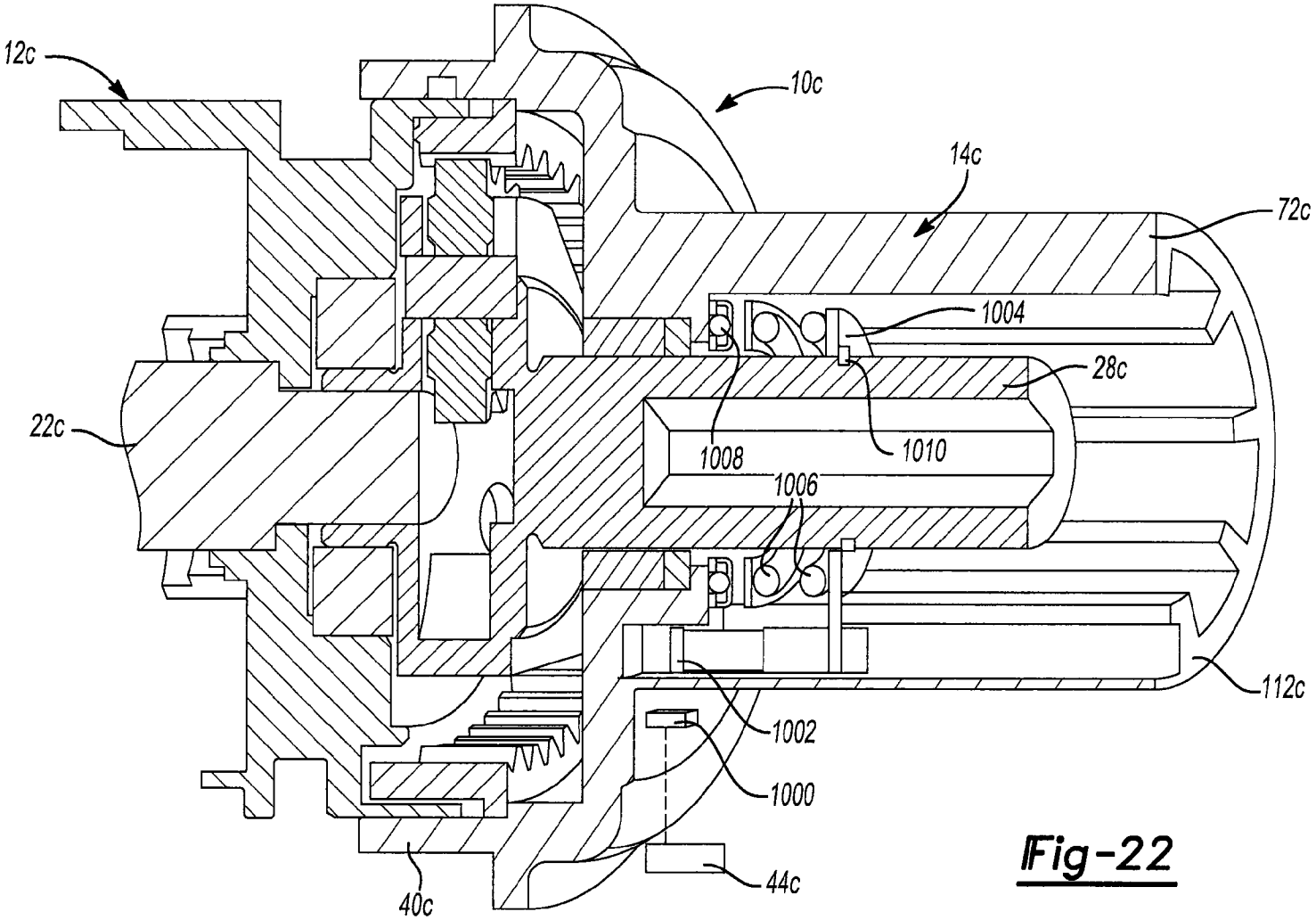
FIG. 22 is a view similar to that of FIG. 21, but illustrating the output member in a retracted position.

To operate the screwdriving tool 10*c*, a tool bit (not shown) can be coupled to the output spindle 28*c* in a conventional manner, a fastener (not shown) can be engaged to the tool bit. The user of the screwdriving tool 10*c* can exert a force can through the screwdriving tool 10*c*, the tool bit, and the fastener onto a workpiece (not shown) such that the output spindle 28*c* is driven rearwardly as shown in FIG. 22. The force should be of sufficient magnitude to overcome the biasing force of the spring 1006 to thereby drive the sensor target 1002 rearwardly toward the sensor 1000 to cause the sensor 1000 to produce the second signal so that the motor assembly 22*c* will operate. Continued rotation of the fastener into the workpiece after contact has occurred between the workpiece and the abutting face 112*c* of the nose element 72*c* permits the spring 1006 to move the sensor target 1002 away from the sensor 1000. When the sensor target 1002 is spaced apart from the sensor 1000 by a distance that is greater than or equal to the predetermined distance, the sensor 1000 can produce the first signal and the controller 44*c* can responsively halt the operation of the motor assembly 22*c* to thereby limit the depth to which the fastener is installed to the workpiece. While the sensor 1000 has been described as being fixedly coupled to the gear case 40*c*, those of skill in the art will appreciate that the sensor 1000 can be adjustably coupled to the gear case 40*c* for axial movement over a predetermined range (e.g., via a screw or detent mechanism) to permit the user to adjust the point at which the sensor 1000 transitions from the second signal to the first signal.

Figure 23:
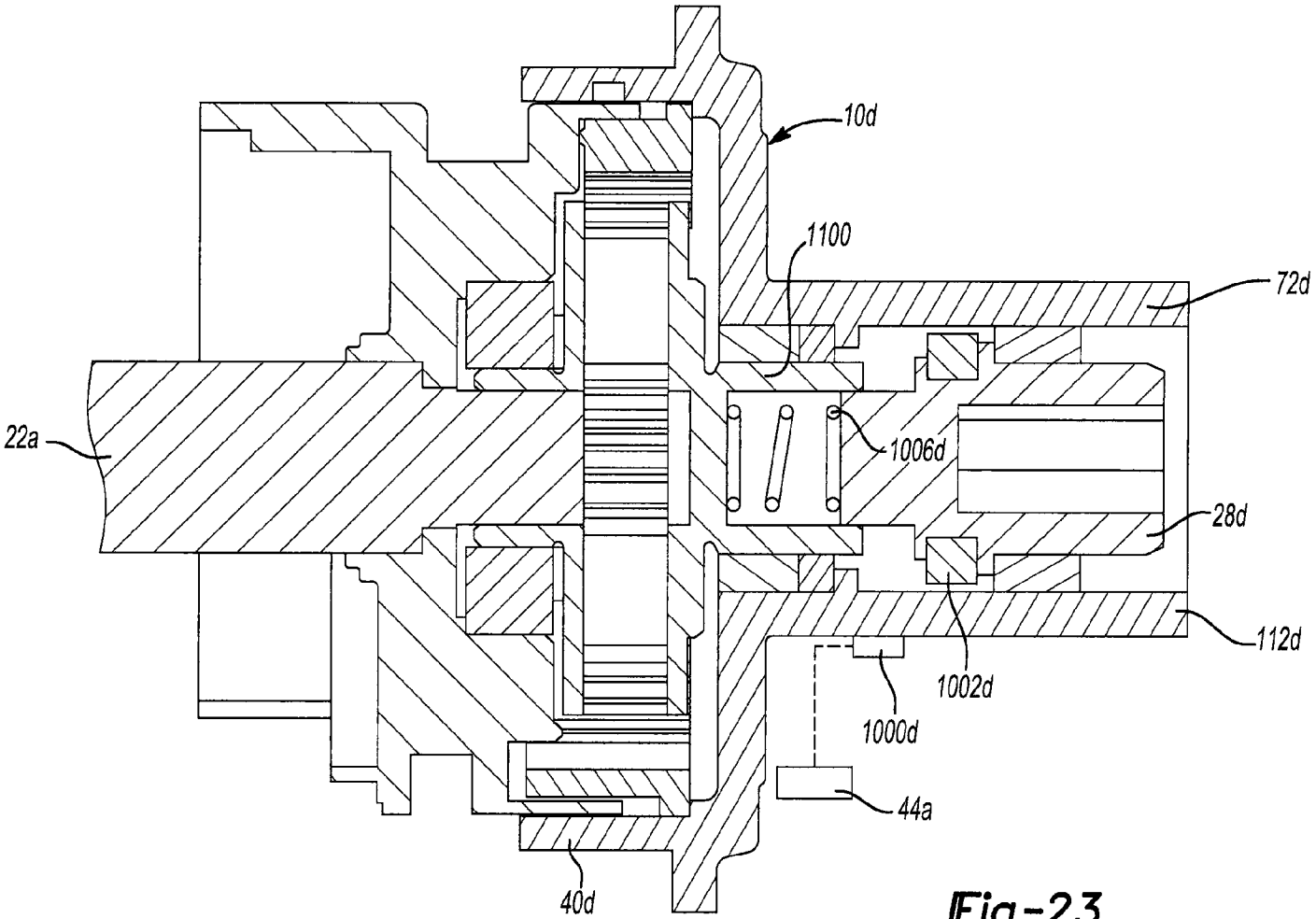
FIG. 23 is a longitudinal section view of a portion of a fifth screwdriving tool constructed in accordance with the teachings of the present disclosure.
Figure 24:
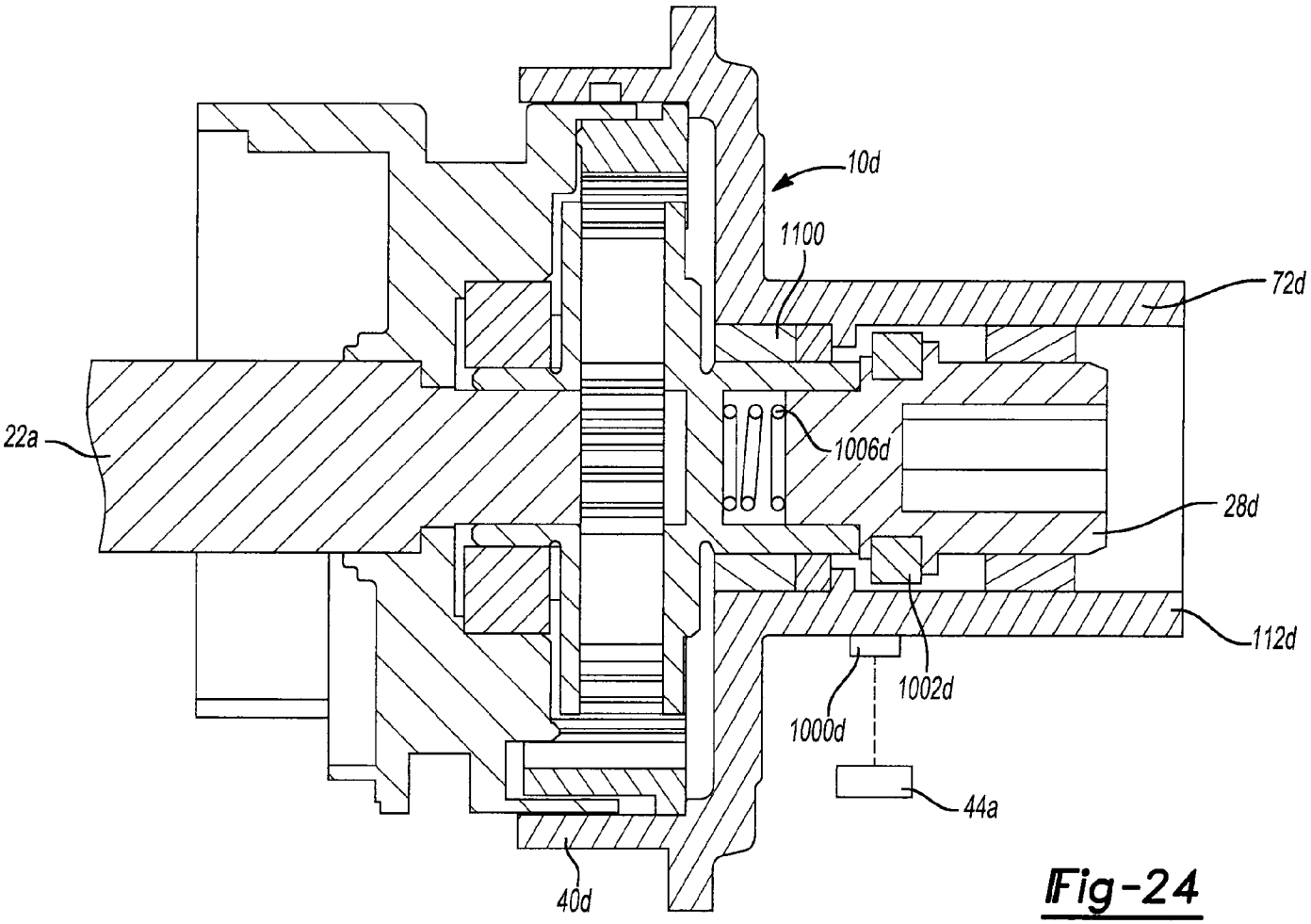
FIG. 24 is a view similar to that of FIG. 23, but illustrating the output member in a retracted position.
Figure 25:
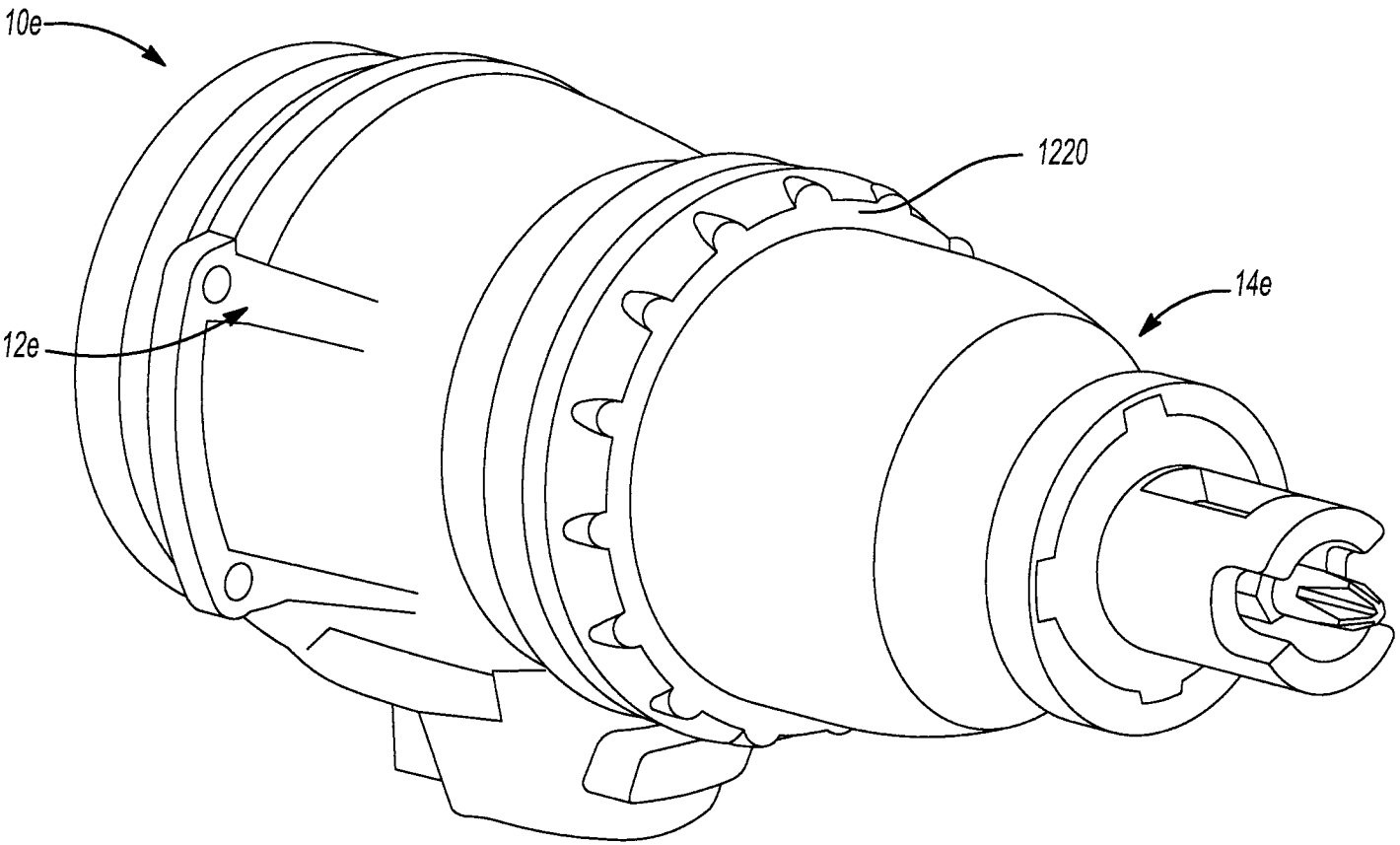
FIG. 25 is a perspective view of a portion of a sixth screwdriving tool constructed in accordance with the teachings of the present disclosure.
Figure 26:
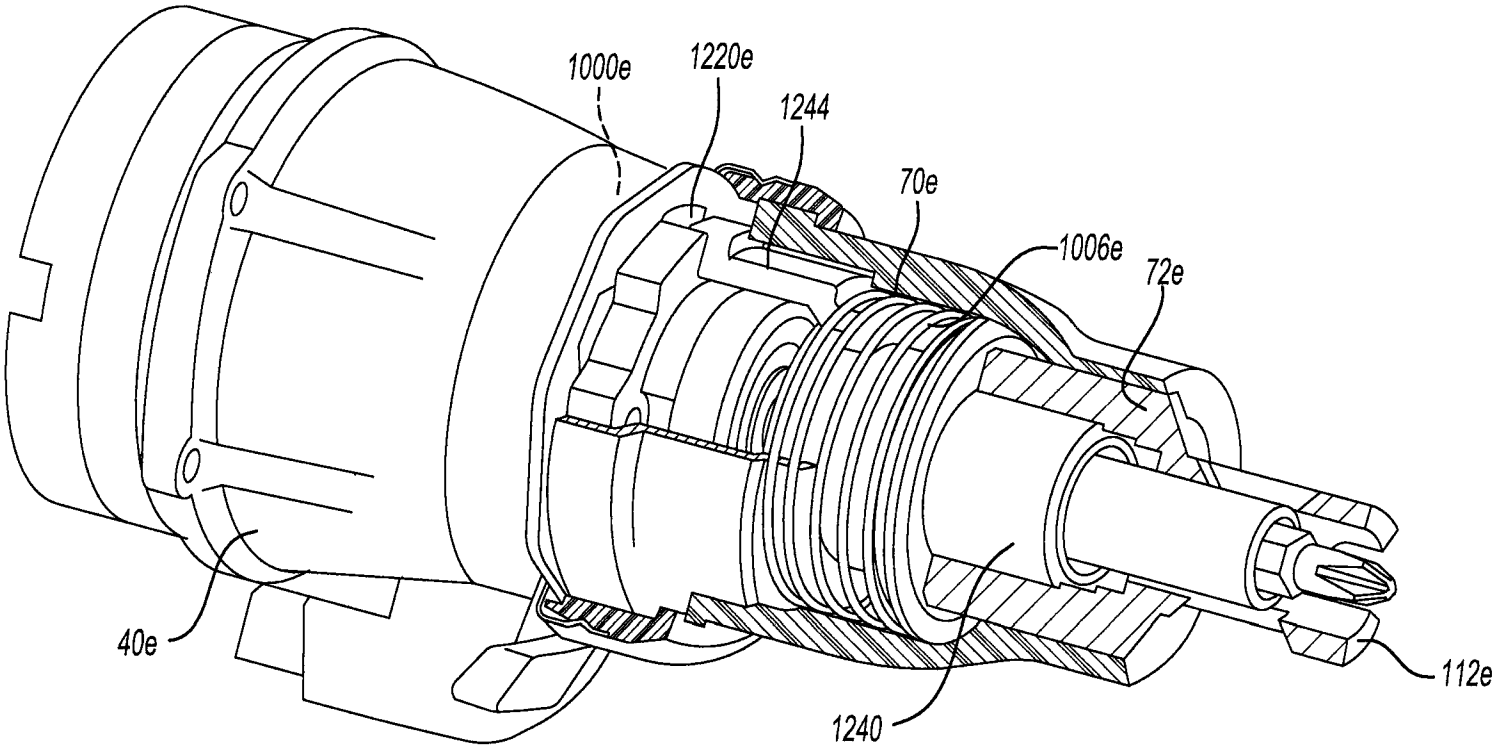
FIG. 26 is a partially broken away perspective view of the screwdriving tool of FIG. 25.
Figure 27:
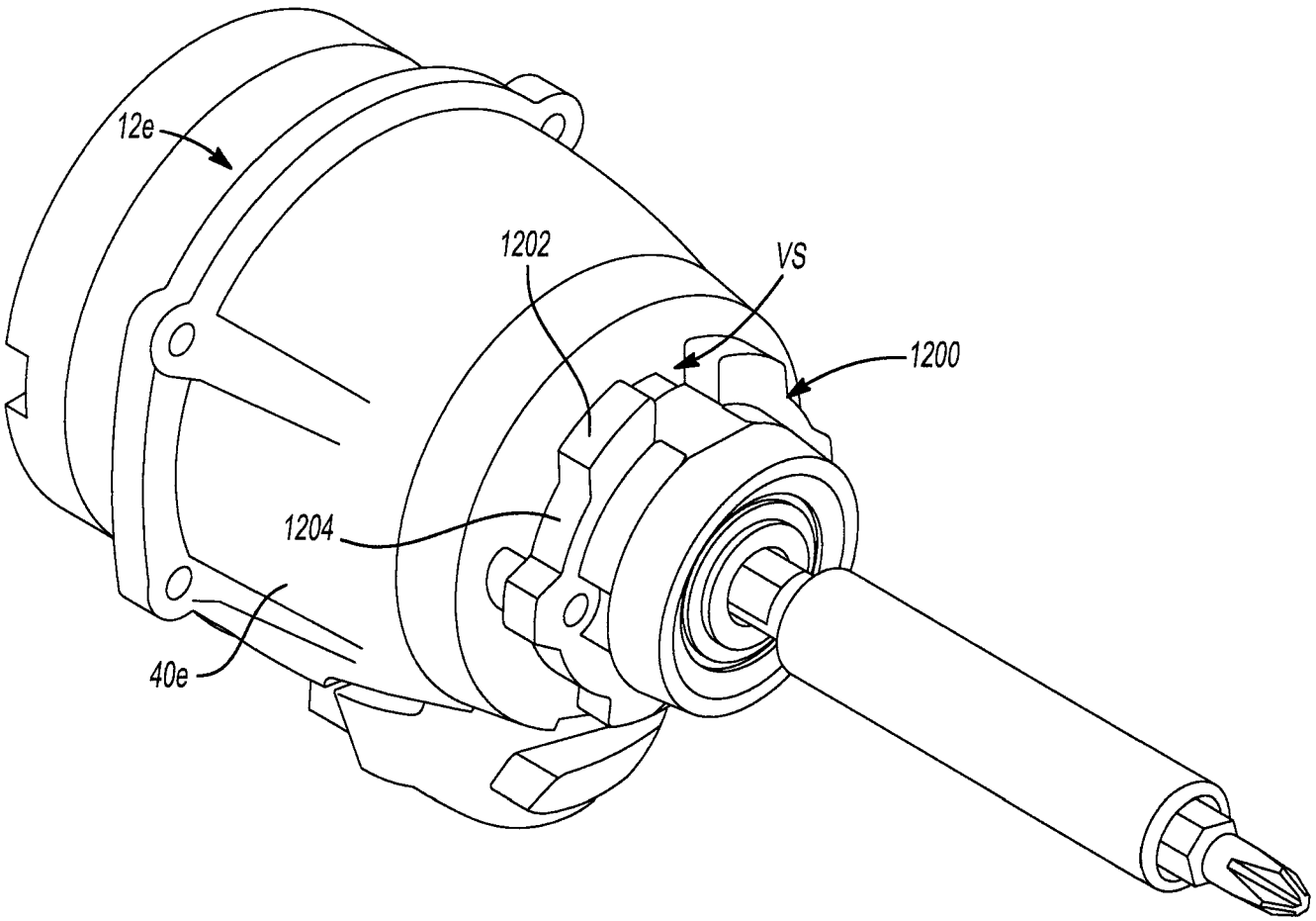
FIG. 27 is a perspective view of a portion of the screwdriving tool of FIG. 25, illustrating the driving tool in more detail.
Figure 28:
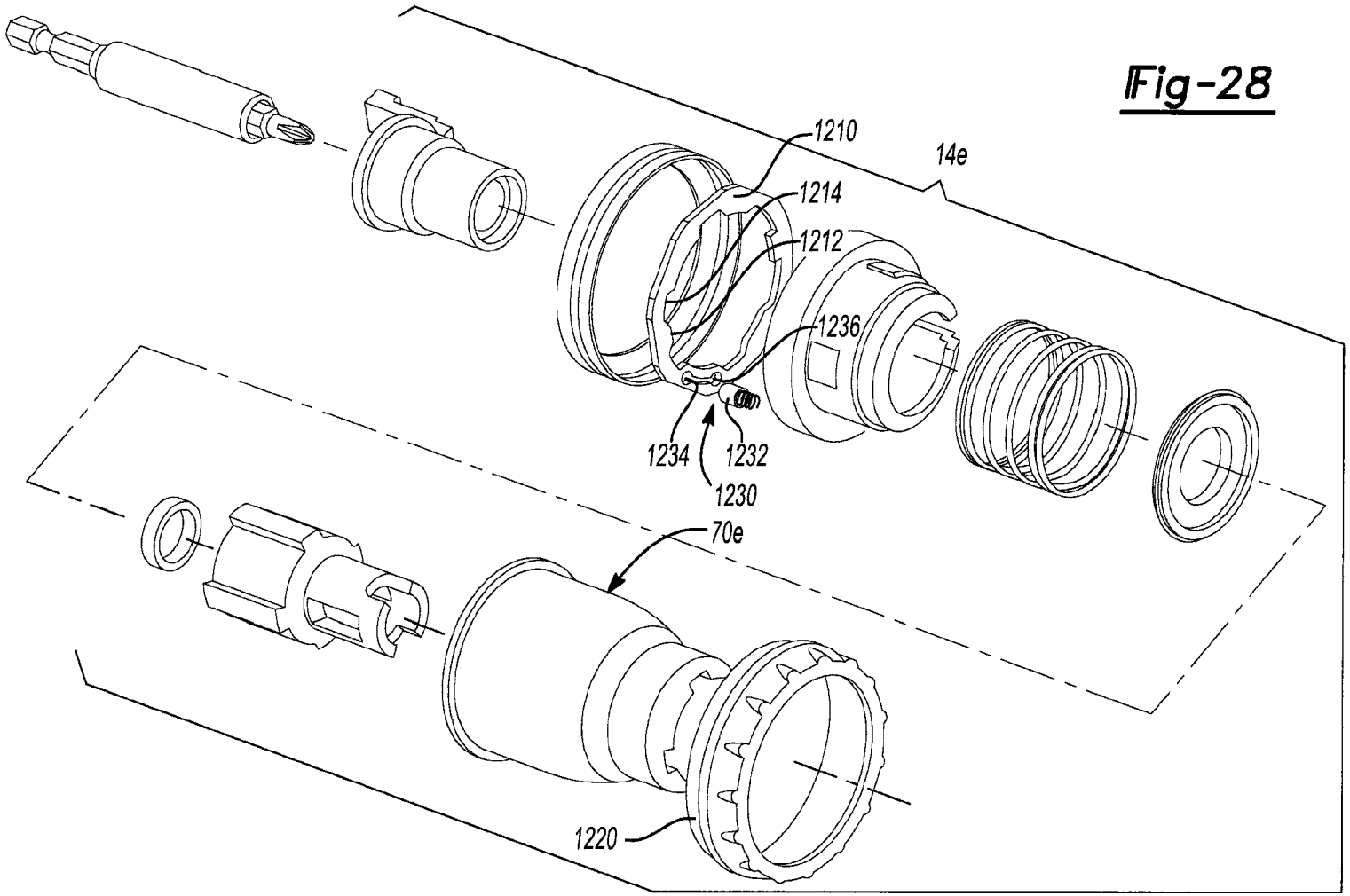
FIG. 28 is an exploded perspective view of a portion of the screwdriving tool of FIG. 25, illustrating the contact trip assembly in more detail.
Figure 29:
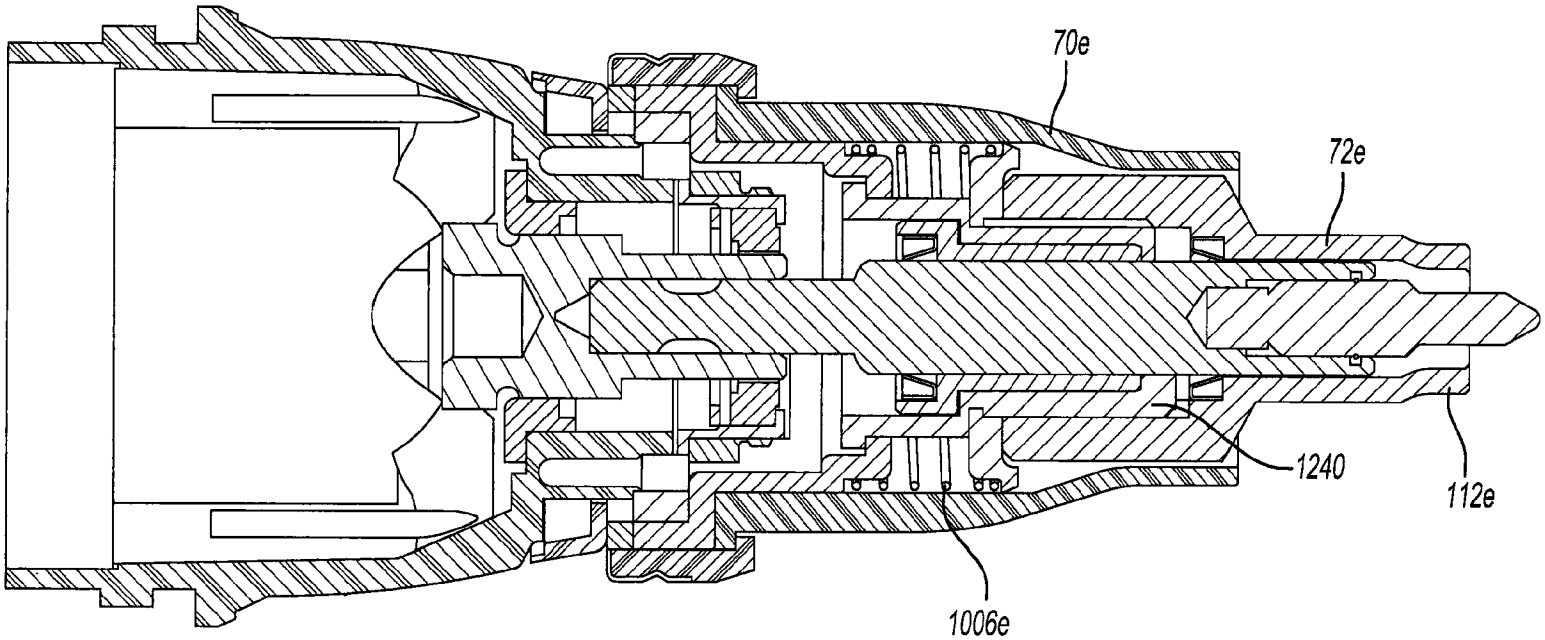
FIG. 29 is a longitudinal section view of a portion of the screwdriving tool of FIG. 25.
Figure 30:
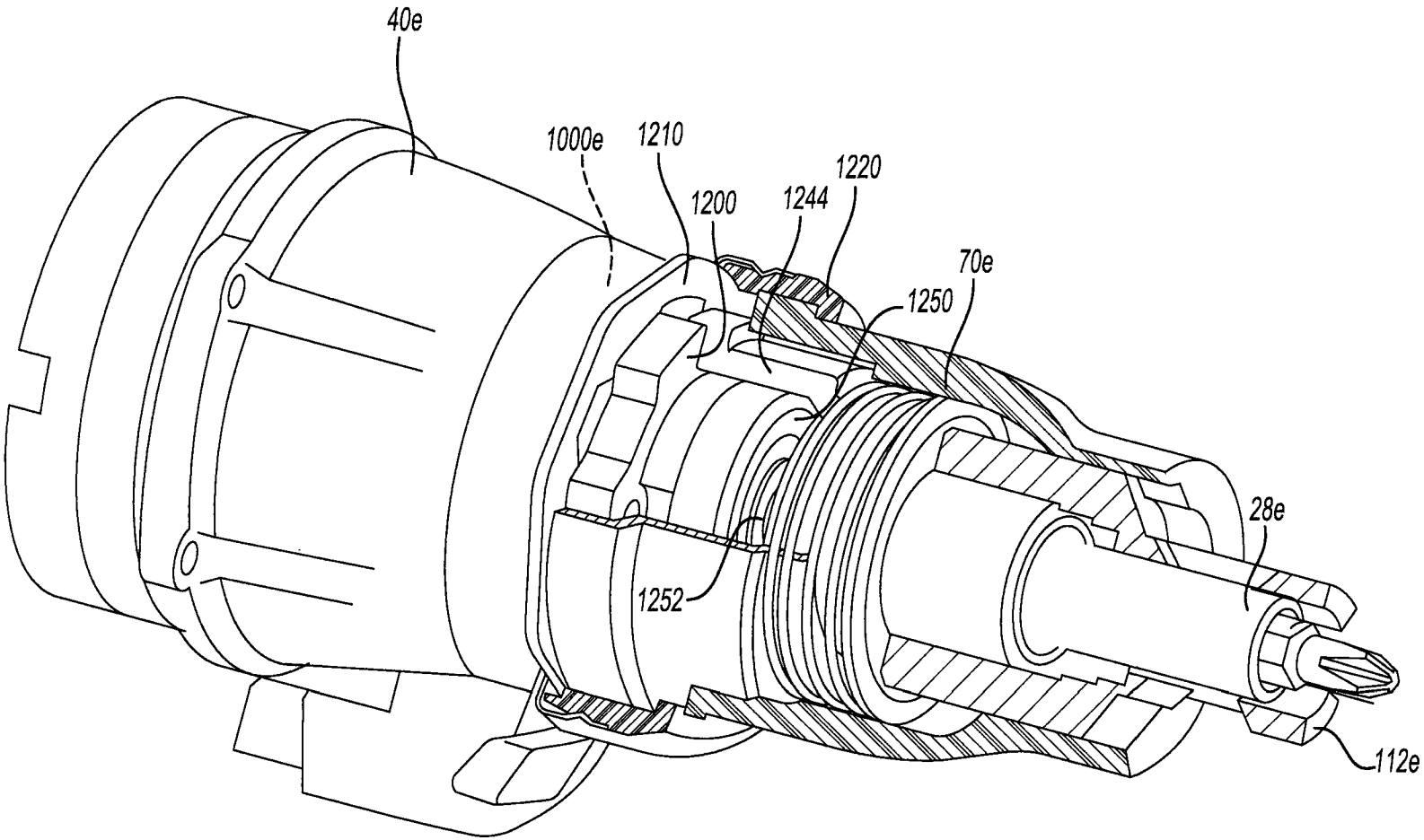
FIG. 30 is a view similar to that of FIG. 26, but illustrating the sensor target in a rearward or retracted position.
Figure 31:
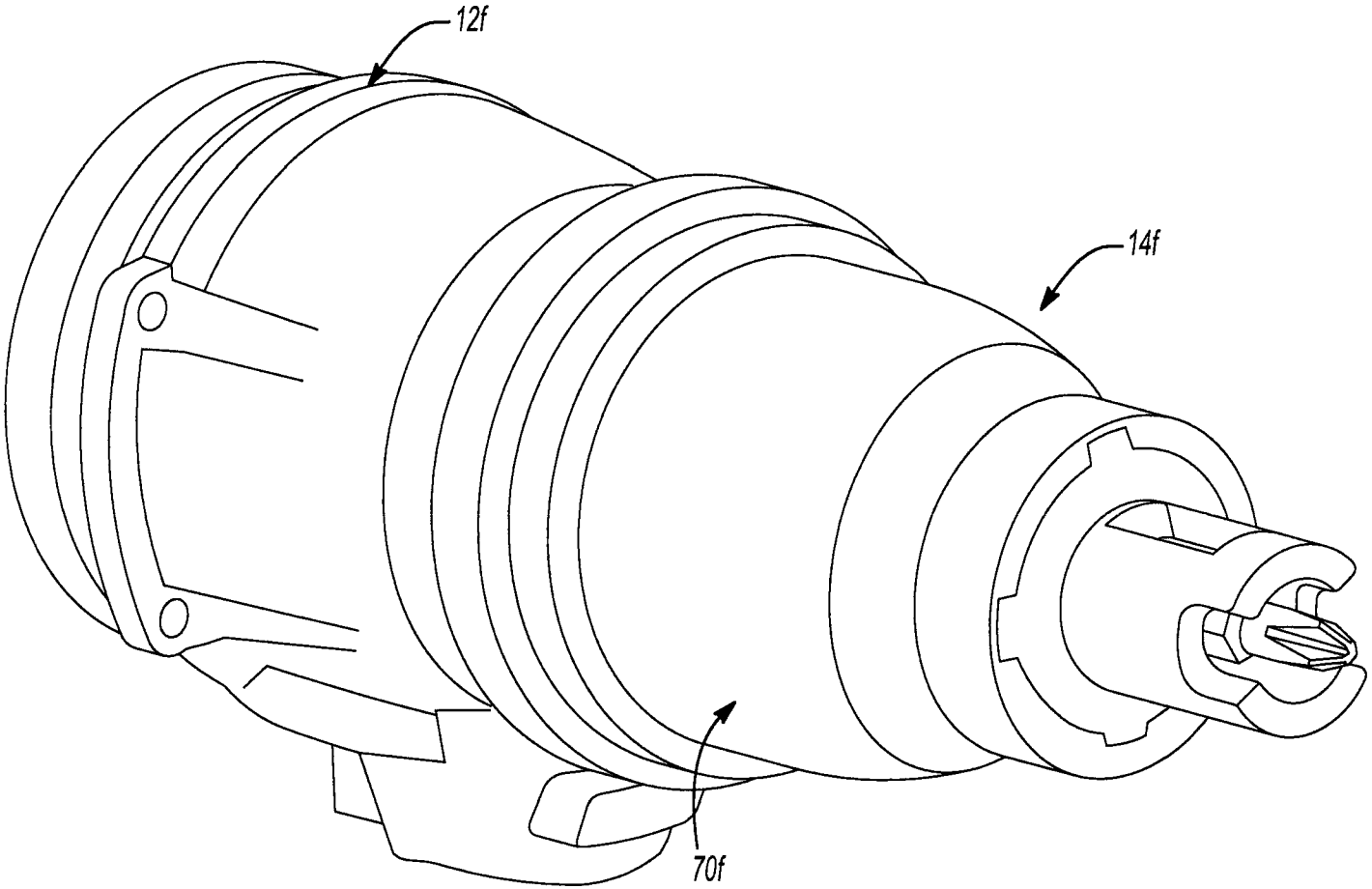
FIG. 31 is a perspective view of a portion of a seventh screwdriving tool constructed in accordance with the teachings of the present disclosure.
Figure 32:
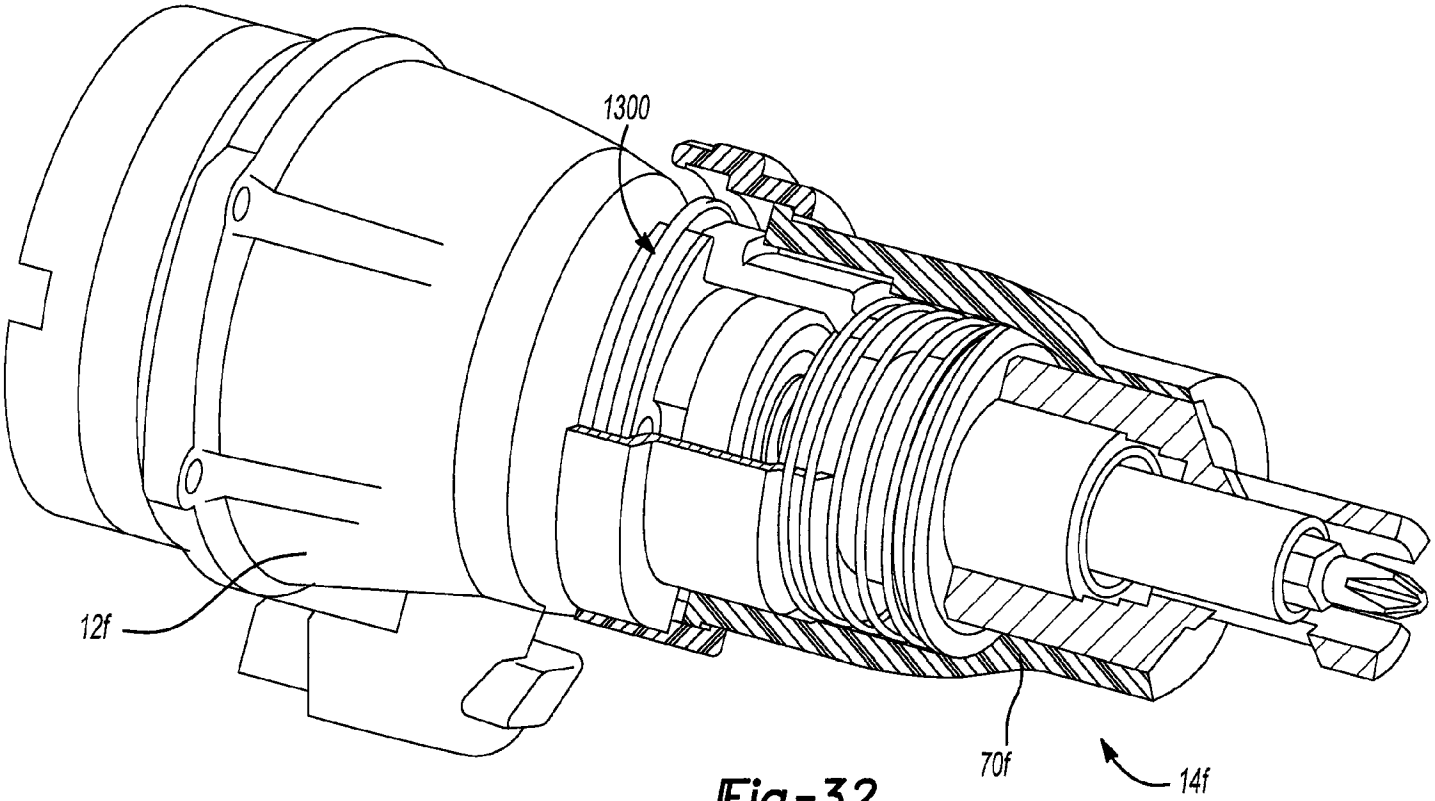
FIG. 32 is a partially broken away perspective view of the screwdriving tool of FIG. 31.
Figure 33:
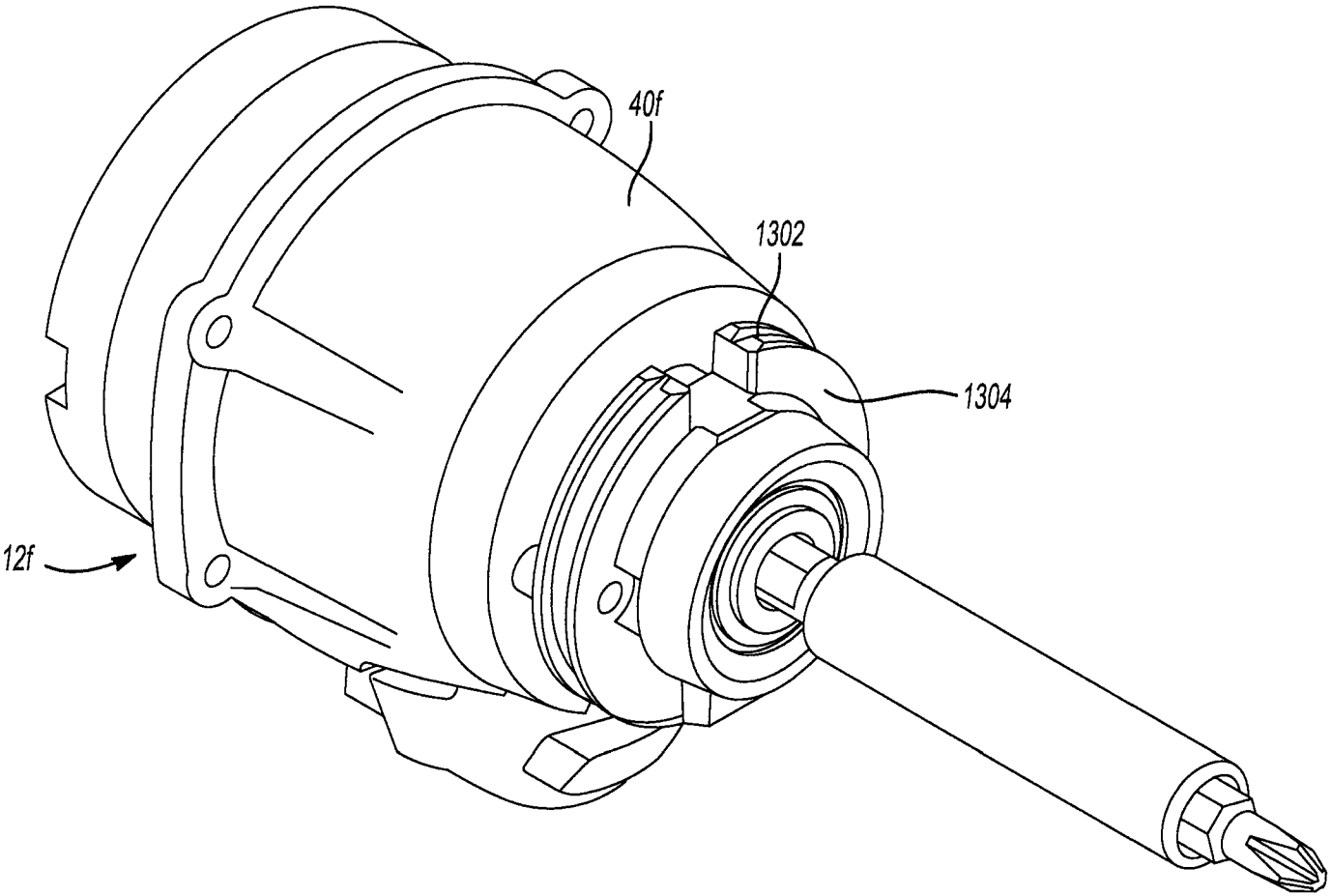
FIG. 33 is a perspective view of a portion of the screwdriving tool of FIG. 31, illustrating the driving tool in more detail.
Figure 34:
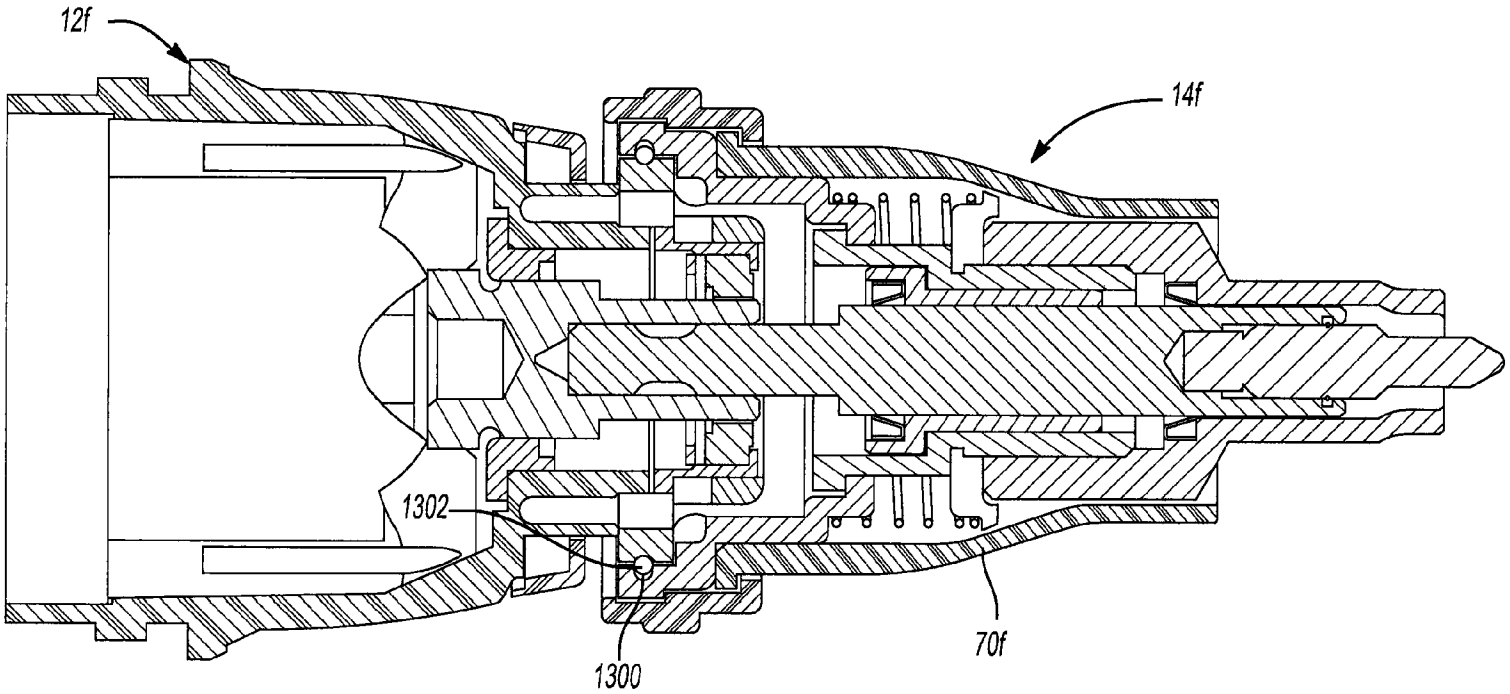
FIG. 34 is a longitudinal section view of a portion of the screwdriving tool of FIG. 31.

Another screwdriving tool constructed in accordance with the teachings of the present disclosure is illustrated in FIGS. 23 and 24 and is generally indicated by reference numeral 10*d*. The screwdriving tool 10*d* is generally similar to the screwdriving tool 10*a* of FIG. 21, except that the output spindle 28*d* is axially movably coupled to an output member 1100 of the transmission 24*d*, the spring 1006*d* is disposed between the output member 1100 and the output spindle 28*d*, and the sensor target 1002*d* is fixedly mounted on the output spindle 28*d*. It will be appreciated that a force applied by the user of the screwdriving tool 10*d* can urge the output spindle 28*d* rearwardly against the bias of the spring 1006*d* to position the sensor target 1002*d* at a location where the sensor 1000*d* can produce the second signal. Continued rotation of a fastener into the workpiece after contact has occurred between the workpiece and the abutting face 112*d* of the nose element 72*d* permits the spring 1006*d* to move the sensor target 1002*d* away from the sensor 1000*d*. When the sensor target 1002*d* is spaced apart from the sensor 1000*d* by a distance that is greater than or equal to the predetermined distance, the sensor 1000*d* can produce the first signal and the controller 44*a* can responsively halt the operation of the motor assembly 22*a* to thereby limit the depth to which the fastener is installed to the workpiece.

While the retaining mechanism 80 and the first attachment member 54 have been depicted as including a pair of retaining clips 150 and a groove 60, respectively, those of skill in the art will appreciate that various other coupling means can be employed in the alternative to releasably couple the contact trip assembly 14 to the driving tool 12. For example, the screwdriving tool 10*e* can include a bayonet-style coupling means for releasably coupling the contact trip assembly 14*e* to the driving tool 12*e* as is depicted in FIGS. 25 through 30.

In this example, a first mount structure 1200 having a plurality of first lugs 1202 and a plurality of first grooves 1204 is coupled to the gear case 40*e*, while a second mount structure 1210, which is rotatably coupled to the contact trip housing 70*e*, has have a plurality of second lugs 1212 and a plurality of second grooves 1214. To install the contact trip assembly 14*e* to the driving tool 12*e*, the second lugs 1212 and second grooves 1214 are aligned to the first grooves 1204 and the first lugs 1202, respectively, the second mount structure 1210 of the contact trip assembly 14*e* is pushed axially over the first mount structure 1200 of the driving tool 12*e* to position the second mount structure 1210 in a void space VS between the gear case 40*e* and the first mount structure 1200, and the second mount structure 1210 is rotated to position the second lugs 1212 axially in-line with the first lugs 1202 to prevent the contact trip assembly 14*e* from being axially withdrawn from the driving tool 12*e*. It will be appreciated that the entire contact trip assembly 14*e* can be rotated relative to the driving tool 12*e* to secure the second mount structure 1210 to the first mount structure 1200, but in the particular example provided, the second mount structure 1210 is fixedly and rotatably coupled to a securing collar 1220 that is rotatably mounted on the contact trip housing 70*e*.

A detent mechanism 1230 can be employed to inhibit undesired rotation of the contact trip assembly 14*e* relative to the driving tool 12*e*. In the example provided, the detent mechanism 1230 comprises a spring-biased detent pin 1232 that is axially slidably mounted in the contact trip housing 70*e*, and first and second recesses 1234 and 1236, respectively. Rotation of the second mount structure 1210 relative to the contact trip housing 70*e* can align the detent pin 1232 with the first recess 1234 or the second recess 1236. Engagement of the detent pin 1232 to the first recess 1234 positions the second mount structure 1210 relative to the contact trip housing 70*e* so that the second lugs 1212 will be aligned to the first grooves 1204 when the contact trip assembly 14*e* is pushed onto the driving tool 12*e*. Engagement of the detent pin 1232 to the second recess 1234 positions the second mount structure 1210 relative to the contact trip housing 70*e* such that the second lugs 1212 will be aligned axially to the first lugs 1202 to thereby inhibit axial withdrawal of the contact trip assembly 14*e* from the driving tool 12*e*.

The contact trip housing 70*e* and driving tool 12*e* can be configured such that engagement of the contact trip housing 70*e* to the driving tool 12*e* inhibits rotation of the contact trip housing 70*e* relative to the driving tool 12*e*. A bushing portion 1240 in the contact trip housing 70*e* can be threadably coupled to the nose element 72*e* to permit adjustment of the depth to which a fastener may be installed. The nose element 72*e* can be biased outwardly from the contact trip housing 70*e* via a spring 1006*e*. The sensor target 1002*e* can be movably mounted on the contact trip housing 70*e* for axial movement with the nose element 72*e*. More specifically, the sensor target 1002*e* can be mounted on an arm 1244 that can be coupled to the bushing portion 1240 such that the bushing portion 1240 can be rotated relative to the arm 1244 but axially translation of the bushing portion 1240 will cause corresponding translation of the arm 1244 (and therefore the sensor target 1002*b*). In the particular example provided, the arm 1244 includes an L-shaped tab 1250 (FIG. 30) that is received into a groove 1252 (FIG. 30) formed about the bushing portion 1240. It will be appreciated that because the bushing portion 1240 is threaded to the nose element 72*e*, and because the arm 1244 is axially fixed to the bushing portion 1240, the spring 1006*e* that biases the nose element 72*e* outwardly away from the gear case 40*e* will also serve to bias the sensor target 1002*e* (which is coupled to an end of the arm 1244 opposite the tab 1250) away from the sensor 1000*e* that is mounted in the gear case 40*e*. In contrast to the manner in which the previous example operates, the controller (not specifically shown) is configured to permit operation of the motor assembly (not specifically shown) when the sensor target 1002*e* is spaced apart from the sensor 1000*e* and to inhibit operation of the motor assembly when the sensor target 1002*e* is disposed within a predetermined distance from the sensor 1000*e*. Accordingly, it will be appreciated that during the run-in of a fastener the abutting face 112*e* of the nose element 72*e* will contact the surface of a workpiece such that the continued run-in of the fastener will cause the nose element 72*e* to be driven rearwardly against the bias of the spring 1006*e* to thereby translate the sensor target 1002*e* rearwardly toward the sensor 1000*e*.

In the example of FIGS. 31 through 34, another coupling means for releasably coupling the contact trip assembly 14*f* to the driving tool 12*f* is illustrated. In this example an annular retaining clip or hog ring 1300 is mounted to the contact trip housing 70*f* and can engage a groove 1302 formed in a mount structure 1304 that is coupled to the gear case 40*f*. The remainder of the driving tool 12*f* and the remainder of the contact trip assembly 14*f* can be generally similar to that of the driving tool 12*f* and that of the contact trip assembly 14*f*, respectively, that are described and illustrated in conjunction with the previous example.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A screwdriving tool comprising a driving tool, a contact trip assembly that is removably coupled to the driving tool, a sensor and a sensor target, the driving tool having a tool housing, a motor assembly and an output member that is driven by the motor assembly, the contact trip assembly having a nose element, one of the nose element and the output member being axially movable and biased by a spring into an extended position, one of the sensor and the sensor target being coupled to the tool housing, the other one of the sensor and the sensor target being coupled to the one of the output member and the nose element for axial movement relative to the one of the sensor and the sensor target, the sensor providing a sensor signal that is based upon a distance between the sensor and the sensor target, wherein the motor assembly is controllable in a first operational mode and at least one rotational direction based in part on the sensor signal;

wherein one of the driving tool and the contact trip assembly includes a clip that is engagable to a circumferentially extending groove in the other one of the driving tool and the contact trip assembly, the clip being movable between an engaged position in which the clip engages the groove to prevent separation of the contact trip assembly from the driving tool, and a disengaged position to permit axial separation of the contact trip assembly from the driving tool.

2. The screwdriving tool of claim 1, wherein the sensor target comprises a magnet.

3. The screwdriving tool of claim 2, wherein the sensor toggles from a first sensor state to a second sensor state as the magnet is moved toward the sensor and the distance between the magnet and the sensor decreases to a predetermined distance.

4. The screwdriving tool of claim 1, wherein a bayonet-type mount is employed to couple the contact trip assembly to the driving tool, the bayonet-type mount comprising a first mount structure, which is coupled to the tool housing of the driving tool, and a second mount structure that is coupled to a contact trip housing of the contact trip assembly, the first and second mount structures having lugs that are engagable to inhibit axial separation of the contact trip assembly from the driving tool.

5. The screwdriving tool of claim 4, wherein the second mount structure is rotatably coupled to the contact trip housing.

6. The screwdriving tool of claim 1, wherein the clip is a hog ring.

7. The screwdriving tool of claim 1, wherein the clip comprises a manually actuateable button that is movable relative to the one of the driving tool and the contact trip assembly to deflect the clip outwardly of the groove to permit axial separation of the contact trip assembly from the driving tool.

8. The screwdriving tool of claim 1, wherein a relative spacing between the output member and the nose element is adjustable.

9. The screwdriving tool of claim 8, wherein the nose element is axially movable relative to a contact trip housing of the contact trip assembly.

10. The screwdriving tool of claim 9, wherein the driving tool comprises a planetary transmission between the motor assembly and the output member.

11. The screwdriving tool of claim 10, wherein the driving tool further comprises a rotary impact mechanism receiving rotary power from the transmission and configured to output rotary power to the output member.

12. The screwdriving tool of claim 1, wherein the motor assembly is a brushed DC motor and the screwdriving tool further comprises a motor direction switch and a direction sensing circuit, the motor direction switch being movable into first and second switch positions to alternate connection of the brushes of the DC motor to first and second terminals, the direction sensing circuit being configured to generate a first signal indicative the coupling of one of the brushes to the first terminal and a second signal indicative of the coupling of the one of the brushes to the second terminal, the first and second signals being generated when the brushed DC motor is operated for a time exceeding a predetermined amount of time.

13. The screwdriving tool of claim 1, wherein at least one sight window is formed through the nose element.

14. The screwdriving tool of claim 1, wherein the motor assembly is controllable in a second operational mode in which operation of the motor assembly is not dependent on the sensor signal.

15. The screwdriving tool of claim 14, wherein the driving tool comprises a motor direction switch, wherein the motor assembly is operated in a forward direction when the motor direction switch is in a first position and a reverse direction when the motor direction switch is in a second position, and wherein the second mode is automatically selected when the driving tool is operated in the reverse direction.

* * * * *